US009447963B2

(12) United States Patent
Beveridge et al.

(10) Patent No.: US 9,447,963 B2
(45) Date of Patent: Sep. 20, 2016

(54) DYNAMIC TUNING OF DYNAMIC MATRIX CONTROL OF STEAM TEMPERATURE

(75) Inventors: Robert A. Beveridge, New Kensington, PA (US); Richard J. Whalen, Jr., Pittsburgh, PA (US)

(73) Assignee: EMERSON PROCESS MANAGEMENT POWER & WATER SOLUTIONS, INC., Pittsburgh, PA (US)

( * ) Notice: Subject to any disclaimer, the term of this patent is extended or adjusted under 35 U.S.C. 154(b) by 1175 days.

(21) Appl. No.: 13/022,237

(22) Filed: Feb. 7, 2011

(65) Prior Publication Data

US 2012/0036852 A1 Feb. 16, 2012

Related U.S. Application Data

(63) Continuation-in-part of application No. 12/856,998, filed on Aug. 16, 2010, now Pat. No. 9,335,042.

(51) Int. Cl.
*F22B 3/00* (2006.01)
*F22G 5/12* (2006.01)

(52) U.S. Cl.
CPC ..... *F22G 5/12* (2013.01)

(58) Field of Classification Search
CPC ..... F22B 35/00; F22B 35/18; G06F 17/11; G06F 17/12
USPC ..... 122/6 R, 479.1; 432/13, 49, 36; 700/28–37, 44–45, 83, 209
See application file for complete search history.

(56) References Cited

U.S. PATENT DOCUMENTS

| | | | |
|---|---|---|---|
| 2,003,419 | A | 6/1935 | Artsay |
| 2,911,789 | A | 11/1959 | Baker |
| 3,016,711 | A | 1/1962 | Shakeshaft |
| 3,244,898 | A | 4/1966 | Hickox |
| 3,550,562 | A | 12/1970 | Strohmeyer, Jr. |

(Continued)

FOREIGN PATENT DOCUMENTS

| | | | |
|---|---|---|---|
| GB | 1 486 570 | A | 9/1977 |
| GB | 2 454 357 | A | 5/2009 |
| GB | 2 482 954 | A | 2/2012 |

OTHER PUBLICATIONS

"DMC"—Jun. 2009.*

(Continued)

*Primary Examiner* — Alissa Tompkins
*Assistant Examiner* — Nathaniel Herzfeld
(74) *Attorney, Agent, or Firm* — Marshall, Gerstein & Borun LLP

(57) ABSTRACT

A technique of controlling a steam generating boiler system includes dynamically tuning a rate of change of a disturbance variable (DV) to control operation of a portion of the boiler system, and in particular, to control a temperature of output steam to a turbine. The rate of change of the DV is dynamically tuned based on a magnitude of an error or difference between an actual and a desired level of an output parameter, e.g., output steam temperature. In an embodiment, as the magnitude of the error increases, the rate of change of the DV is increased according to a function f(x). A dynamic matrix control block uses the dynamically-tuned rate of change of the DV, a current output parameter level, and an output parameter setpoint as inputs to generate a control signal to control a field device that, at least in part, affects the output parameter level.

10 Claims, 13 Drawing Sheets

(56) References Cited

U.S. PATENT DOCUMENTS 3,588,265 A 6/1971 Berry
3,837,167 A 9/1974 Durrant et al.
3,873,817 A 3/1975 Liang
3,875,384 A 4/1975 Davis
3,878,401 A 4/1975 Ronnen
3,879,616 A 4/1975 Baker et al.
3,898,441 A 8/1975 Davis et al.
3,911,286 A 10/1975 Uram
3,930,367 A 1/1976 Gasparoli
3,934,128 A 1/1976 Uram
3,937,934 A 2/1976 Pasemann
3,939,328 A 2/1976 Davis
3,948,043 A 4/1976 Martz
3,955,358 A 5/1976 Martz et al.
3,959,635 A 5/1976 Tanco
3,973,391 A 8/1976 Reed et al.
4,013,877 A 3/1977 Uram et al.
4,025,765 A 5/1977 Giras et al.
4,027,145 A 5/1977 McDonald et al.
4,028,884 A 6/1977 Martz et al.
4,029,255 A 6/1977 Heiser et al.
4,029,952 A 6/1977 Giras et al.
4,031,372 A 6/1977 Davis
4,035,624 A 7/1977 Lardi
4,037,088 A 7/1977 Davis et al.
4,047,005 A 9/1977 Heiser et al.
4,053,746 A 10/1977 Braytenbah et al.
4,053,747 A 10/1977 Davis
4,057,715 A 11/1977 Jones et al.
4,061,533 A 12/1977 Durrant
4,064,699 A 12/1977 Martz
4,086,773 A 5/1978 Kanegae et al.
4,090,065 A 5/1978 Braytenbah et al.
4,168,608 A 9/1979 Uram
4,184,324 A 1/1980 Kiscaden et al.
4,195,231 A 3/1980 Reed et al.
4,201,924 A 5/1980 Uram
4,205,380 A 5/1980 Braytenbah
4,220,869 A 9/1980 Uram
4,222,229 A 9/1980 Uram
4,227,093 A 10/1980 Uram et al.
4,236,220 A 11/1980 Kogami et al.
4,245,162 A 1/1981 Ronnen et al.
4,246,491 A 1/1981 Waldron et al.
4,258,424 A 3/1981 Giras et al.
4,267,458 A 5/1981 Uram et al.
4,270,055 A 5/1981 Ronnen et al.
4,333,310 A 6/1982 Uram
4,353,204 A 10/1982 Arakawa
4,427,896 A 1/1984 Waldron
4,445,180 A 4/1984 Davis et al.
4,471,620 A 9/1984 Binstock et al.
4,578,944 A 4/1986 Martens et al.
4,589,255 A 5/1986 Martens et al.
4,619,224 A 10/1986 Takita et al.
4,637,348 A 1/1987 Fukayama
4,644,479 A 2/1987 Kemper et al.
4,687,946 A 8/1987 Jones
4,888,953 A 12/1989 Fukayama et al.
4,975,238 A 12/1990 Regan et al.
5,091,844 A 2/1992 Waltz
5,237,816 A 8/1993 Duffy et al.
5,268,835 A 12/1993 Miyagaki et al.
5,413,175 A 5/1995 Edmunds
5,453,925 A 9/1995 Wojsznis et al.
5,485,754 A 1/1996 Harpster
5,517,424 A 5/1996 Marcelle et al.
5,568,378 A 10/1996 Wojsznis
5,594,858 A 1/1997 Blevins
5,646,513 A 7/1997 Riggio, Jr.
5,752,411 A 5/1998 Harpster
5,841,652 A 11/1998 Sanchez
5,943,865 A 8/1999 Cohen
6,109,019 A 8/2000 Sugishita
6,223,520 B1 5/2001 Kita
6,445,962 B1 9/2002 Blevins et al.
6,445,963 B1 9/2002 Blevins et al.
6,453,308 B1 9/2002 Zhao et al.
6,459,939 B1 10/2002 Hugo
6,501,998 B1 12/2002 Pfeiffer
6,510,351 B1 1/2003 Blevins et al.
6,577,908 B1 6/2003 Wojsznis et al.
6,609,361 B2 8/2003 Vugdelija
6,681,155 B1 1/2004 Fujita et al.
6,721,609 B1 4/2004 Wojsznis et al.
6,847,954 B1 1/2005 Wojsznis et al.
6,901,300 B2 5/2005 Blevins et al.
6,970,750 B2 11/2005 Wojsznis et al.
7,043,311 B2 5/2006 Nixon et al.
7,110,835 B2 9/2006 Blevins et al.
7,113,834 B2 9/2006 Wojsznis et al.
7,117,052 B2 10/2006 Lucas et al.
7,242,989 B2 7/2007 Blevins et al.
7,272,454 B2 9/2007 Wojsznis et al.
7,317,953 B2 1/2008 Wojsznis et al.
7,337,022 B2 2/2008 Wojsznis et al.
7,346,472 B1 3/2008 Moskowitz et al.
7,376,472 B2 5/2008 Wojsznis et al.
7,421,354 B2 9/2008 Brunell
7,451,004 B2 11/2008 Thiele et al.
7,496,041 B2 2/2009 Blevins et al.
7,526,347 B2 4/2009 Lucas et al.
7,551,969 B2 6/2009 Wojsznis et al.
7,587,252 B2 9/2009 Blevins et al.
7,596,198 B1 9/2009 Srinivasan
7,620,460 B2 11/2009 Blevins et al.
7,647,126 B2 1/2010 Blevins et al.
7,702,409 B2 4/2010 Lucas et al.
7,729,789 B2 6/2010 Blevins et al.
7,729,792 B2 6/2010 Lucas et al.
7,738,975 B2 6/2010 Denison et al.
7,826,908 B2 11/2010 Cheng et al.
7,840,287 B2 11/2010 Wojsznis et al.
7,856,281 B2 12/2010 Thiele et al.
7,877,154 B2 1/2011 Blevins et al.
7,922,155 B2 4/2011 Havlena
7,930,045 B2 4/2011 Cheng
7,945,339 B2 5/2011 Blevins et al.
7,971,052 B2 6/2011 Lucas et al.
8,046,096 B2 10/2011 Denison et al.
8,055,358 B2 11/2011 Blevins et al.
8,060,834 B2 11/2011 Lucas et al.
8,127,241 B2 2/2012 Blevins et al.
8,135,481 B2 3/2012 Blevins et al.
8,185,217 B2 5/2012 Thiele
8,200,346 B2 6/2012 Thiele
8,280,533 B2 10/2012 Wojsznis et al.
8,326,666 B2 12/2012 Caldwell et al.
8,433,450 B2 4/2013 Francino et al.
8,473,087 B2 6/2013 Lucas et al.
8,509,926 B2 8/2013 Blevins et al.
2001/0021900 A1 9/2001 Kassmann
2002/0071975 A1 6/2002 Shimazu
2002/0120352 A1 8/2002 Stothert et al.
2003/0028265 A1* 2/2003 Martin ..... G05B 17/02 700/31
2003/0046939 A1 3/2003 Hyakutake et al.
2003/0067355 A1* 4/2003 Wojsznis ..... G05B 13/024 331/2
2003/0120359 A1 6/2003 O'Leary et al.
2004/0050072 A1 3/2004 Palfy et al.
2004/0050076 A1 3/2004 Palfy et al.
2004/0244729 A1 12/2004 Lefebvre et al.
2005/0096872 A1 5/2005 Blevins et al.
2005/0136303 A1 6/2005 Kobayshi et al.
2006/0052902 A1 3/2006 Lefebvre et al.
2006/0191896 A1 8/2006 Cheng et al.
2006/0224534 A1 10/2006 Hartman et al.
2006/0283406 A1 12/2006 Francino et al.
2007/0042768 A1 2/2007 Gazeley
2007/0055392 A1 3/2007 D'Amato et al.
2007/0129917 A1 6/2007 Blevins et al.
2007/0151243 A1 7/2007 Stewart
2007/0174225 A1 7/2007 Blevins et al.

(56) References Cited

U.S. PATENT DOCUMENTS

| | | | |
|---|---|---|---|
| 2007/0198104 | A1 | 8/2007 | Sayyarrodsari et al. |
| 2007/0208549 | A1 | 9/2007 | Blevins et al. |
| 2008/0016647 | A1 | 1/2008 | Francino et al. |
| 2008/0029261 | A1 | 2/2008 | Kephart et al. |
| 2008/0077257 | A1 | 3/2008 | Peterson et al. |
| 2008/0082180 | A1 | 4/2008 | Blevins et al. |
| 2008/0125881 | A1 | 5/2008 | Grott et al. |
| 2008/0141953 | A1 | 6/2008 | Hirayama et al. |
| 2008/0148713 | A1 | 6/2008 | White et al. |
| 2008/0244975 | A1 | 10/2008 | Johnston |
| 2008/0288198 | A1 | 11/2008 | Francino et al. |
| 2008/0302102 | A1 | 12/2008 | Cheng et al. |
| 2009/0012653 | A1 | 1/2009 | Cheng et al. |
| 2009/0016609 | A1 | 1/2009 | Zakrzewski et al. |
| 2009/0040367 | A1 | 2/2009 | Zakrzewski et al. |
| 2009/0056036 | A1 | 3/2009 | Herkle et al. |
| 2009/0063113 | A1 | 3/2009 | Francino et al. |
| 2009/0089247 | A1 | 4/2009 | Blevins et al. |
| 2009/0118873 | A1 | 5/2009 | Cheng et al. |
| 2010/0062381 | A1 | 3/2010 | Gross et al. |
| 2010/0077970 | A1 | 4/2010 | Kumar et al. |
| 2010/0162700 | A1 | 7/2010 | Birnbaum et al. |
| 2010/0236241 | A1 | 9/2010 | Kumar et al. |
| 2010/0241249 | A1 | 9/2010 | Jia et al. |
| 2010/0318934 | A1 | 12/2010 | Blevins et al. |
| 2011/0040390 | A1 | 2/2011 | Blevins et al. |
| 2011/0066298 | A1 | 3/2011 | Francino et al. |
| 2011/0131017 | A1 | 6/2011 | Cheng et al. |
| 2011/0131455 | A1 | 6/2011 | Law et al. |
| 2011/0218782 | A1 | 9/2011 | Coughran et al. |
| 2011/0224808 | A1 | 9/2011 | Lucas et al. |
| 2011/0230980 | A1 | 9/2011 | Hammack et al. |
| 2011/0245937 | A1 | 10/2011 | Rawson et al. |
| 2011/0288660 | A1 | 11/2011 | Wojsznis et al. |
| 2011/0288786 | A1 | 11/2011 | Blevins et al. |
| 2011/0288837 | A1 | 11/2011 | Blevins et al. |
| 2012/0010757 | A1 | 1/2012 | Francino et al. |
| 2012/0010758 | A1 | 1/2012 | Francino et al. |
| 2012/0030852 | A1 | 2/2012 | Anscher |
| 2012/0040298 | A1 | 2/2012 | Beveridge et al. |
| 2012/0040299 | A1 | 2/2012 | Beveridge et al. |
| 2013/0085795 | A1 | 4/2013 | Caldwell et al. |
| 2013/0110298 | A1 | 5/2013 | Beveridge |

OTHER PUBLICATIONS

Qin, S. Joe and Thomas A. Badgwell, "An Overview of Industrial Model Predictive Control Technology," *AIChE Conference*, 1996.

Search Report for Application No. GB1112940.0, dated Nov. 9, 2011.

Search Report for Application No. GB1113709.8, dated Nov. 16, 2011.

Search Report for Application No. GB1113708.0, dated Nov. 16, 2011.

Moon et al., Step-response model development for dynamic matrix control of a drum-type boiler-turbine system, IEEE Transactions on Energy Conversion, vol. 24, 423-430(2009).

Search Report for Application No. GB1219482.5, dated Feb. 5, 2013.

* cited by examiner

DYNAMIC TUNING OF DYNAMIC MATRIX CONTROL OF STEAM TEMPERATURE

CROSS REFERENCE TO RELATED APPLICATIONS

This application is a Continuation-in-Part of pending U.S. application Ser. No. 12/856,998, filed Aug. 16, 2010 and entitled "Steam Temperature Control Using Dynamic Matrix Control", the contents of which are hereby expressly incorporated by reference herein.

BACKGROUND

A variety of industrial as well as non-industrial applications use fuel burning boilers which typically operate to convert chemical energy into thermal energy by burning one of various types of fuels, such as coal, gas, oil, waste material, etc. An exemplary use of fuel burning boilers is in thermal power generators, wherein fuel burning boilers generate steam from water traveling through a number of pipes and tubes within the boiler, and the generated steam is then used to operate one or more steam turbines to generate electricity. The output of a thermal power generator is a function of the amount of heat generated in a boiler, wherein the amount of heat is directly determined by the amount of fuel consumed (e.g., burned) per hour, for example.

In many cases, power generating systems include a boiler which has a furnace that burns or otherwise uses fuel to generate heat which, in turn, is transferred to water flowing through pipes or tubes within various sections of the boiler. A typical steam generating system includes a boiler having a superheater section (having one or more sub-sections) in which steam is produced and is then provided to and used within a first, typically high pressure, steam turbine. To increase the efficiency of the system, the steam exiting this first steam turbine may then be reheated in a reheater section of the boiler, which may include one or more subsections, and the reheated steam is then provided to a second, typically lower pressure steam turbine. While the efficiency of a thermal-based power generator is heavily dependent upon the heat transfer efficiency of the particular furnace/boiler combination used to burn the fuel and transfer the heat to the water flowing within the various sections of the boiler, this efficiency is also dependent on the control technique used to control the temperature of the steam in the various sections of the boiler, such as in the superheater section of the boiler and in the reheater section of the boiler.

However, as will be understood, the steam turbines of a power plant are typically run at different operating levels at different times to produce different amounts of electricity based on energy or load demands. For most power plants using steam boilers, the desired steam temperature setpoints at final superheater and reheater outlets of the boilers are kept constant, and it is necessary to maintain steam temperature close to the setpoints (e.g., within a narrow range) at all load levels. In particular, in the operation of utility (e.g., power generation) boilers, control of steam temperature is critical as it is important that the temperature of steam exiting from a boiler and entering a steam turbine is at an optimally desired temperature. If the steam temperature is too high, the steam may cause damage to the blades of the steam turbine for various metallurgical reasons. On the other hand, if the steam temperature is too low, the steam may contain water particles, which in turn may cause damage to components of the steam turbine over prolonged operation of the steam turbine as well as decrease efficiency of the operation of the turbine. Moreover, variations in steam temperature also cause metal material fatigue, which is a leading cause of tube leaks.

Typically, each section (i.e., the superheater section and the reheater section) of the boiler contains cascaded heat exchanger sections wherein the steam exiting from one heat exchanger section enters the following heat exchanger section with the temperature of the steam increasing at each heat exchanger section until, ideally, the steam is output to the turbine at the desired steam temperature. In such an arrangement, steam temperature is controlled primarily by controlling the temperature of the water at the output of the first stage of the boiler which is primarily achieved by changing the fuel/air mixture provided to the furnace or by changing the ratio of firing rate to input feedwater provided to the furnace/boiler combination. In once-through boiler systems, in which no drum is used, the firing rate to feedwater ratio input to the system may be used primarily to regulate the steam temperature at the input of the turbines.

While changing the fuel/air ratio and the firing rate to feedwater ratio provided to the furnace/boiler combination operates well to achieve desired control of the steam temperature over time it is difficult to control short term fluctuations in steam temperature at the various sections of the boiler using only fuel/air mixture control and firing rate to feedwater ratio control. Instead, to perform short term (and secondary) control of steam temperature, saturated water is sprayed into the steam at a point before the final heat exchanger section located immediately upstream of the turbine. This secondary steam temperature control operation typically occurs before the final superheater section of the boiler and/or before the final reheater section of the boiler. To effect this operation, temperature sensors are provided along the steam flow path and between the heat exchanger sections to measure the steam temperature at critical points along the flow path, and the measured temperatures are used to regulate the amount of saturated water sprayed into the steam for steam temperature control purposes.

In many circumstances, it is necessary to rely heavily on the spray technique to control the steam temperature as precisely as needed to satisfy the turbine temperature constraints described above. In one example, once-through boiler systems, which provide a continuous flow of water (steam) through a set of pipes within the boiler and do not use a drum to, in effect, average out the temperature of the steam or water exiting the first boiler section, may experience greater fluctuations in steam temperature and thus typically require heavier use of the spray sections to control the steam temperature at the inputs to the turbines. In these systems, the firing rate to feedwater ratio control is typically used, along with superheater spray flow, to regulate the furnace/boiler system. In these and other boiler systems, a distributed control system (DCS) uses cascaded PID (Proportional Integral Derivative) controllers to control both the fuel/air mixture provided to the furnace as well as the amount of spraying performed upstream of the turbines.

However, cascaded PID controllers typically respond in a reactionary manner to a difference or error between a setpoint and an actual value or level of a dependent process variable to be controlled, such as a temperature of steam to be delivered to the turbine. That is, the control response occurs after the dependent process variable has already drifted from its set point. For example, spray valves that are upstream of a turbine are controlled to readjust their spray flow only after the temperature of the steam delivered to the turbine has drifted from its desired target. Needless to say, this reactionary control response coupled with changing boiler operating conditions can result in large temperature swings that cause stress on the boiler system and shorten the lives of tubes, spray control valves, and other components of the system.

SUMMARY

An embodiment of a method for dynamically tuning control of a steam generating boiler system may include determining a presence of an error corresponding to a temperature of output steam, where the output steam is generated by the steam generating boiler system for delivery to a turbine. The method may also include adjusting, based on the error, a signal indicative of a rate of change of a disturbance variable used in the steam generating boiler system and generating, by a dynamic matrix controller, a control signal based on the adjusted signal indicative of the rate of change of the disturbance variable. The method may further include controlling the temperature of the output steam based on the control signal.

An embodiment of a dynamically-tuned controller unit for use in a steam generating boiler system may include a dynamically-tuned controller unit that is communicatively coupled to a field device and to a boiler of the steam generating boiler system. The dynamically-tuned controller unit may comprise a dynamic matrix controller (DMC) that includes a first DMC input to receive a signal indicative of a rate of change of a disturbance variable of the steam generating boiler system, a second DMC input to receive a signal corresponding to an error corresponding to a temperature of output steam generated by the steam generating boiler system, and a dynamic matrix control routine. The dynamic matrix control routine may be configured to, when executed, adjust the signal indicative of the rate of change of the disturbance variable based on the signal corresponding to the error, and determine a control signal using the adjusted signal indicative of the rate of change of the disturbance variable. The DMC may further include a DMC output to provide the control signal to the field device to control the output steam temperature.

An embodiment of a steam generating boiler system may comprise a boiler, a field device, a controller that is communicatively coupled to the boiler and to the field device, and a dynamically-tuned control system. The dynamically-tuned control system may be communicatively connected to the controller to receive a signal indicative of a rate of change of a disturbance variable. The dynamically-tuned control system may include a routine that, when executed, modifies the signal indicative of the rate of change of the disturbance variable based on a magnitude of a difference between a setpoint and a level of an output parameter of the boiler, generates a control signal based on the modified signal indicative of the rate of change of the disturbance variable, and provides the control signal to the field device to control the level of the output parameter of the boiler.

DETAILED DESCRIPTION

Although the following text sets forth a detailed description of numerous different embodiments of the invention, it should be understood that the legal scope of the invention is defined by the words of the claims set forth at the end of this patent. The detailed description is to be construed as exemplary only and does not describe every possible embodiment of the invention as describing every possible embodiment would be impractical, if not impossible. Numerous alternative embodiments could be implemented, using either current technology or technology developed after the filing date of this patent, which would still fall within the scope of the claims defining the invention.

Figure 1:
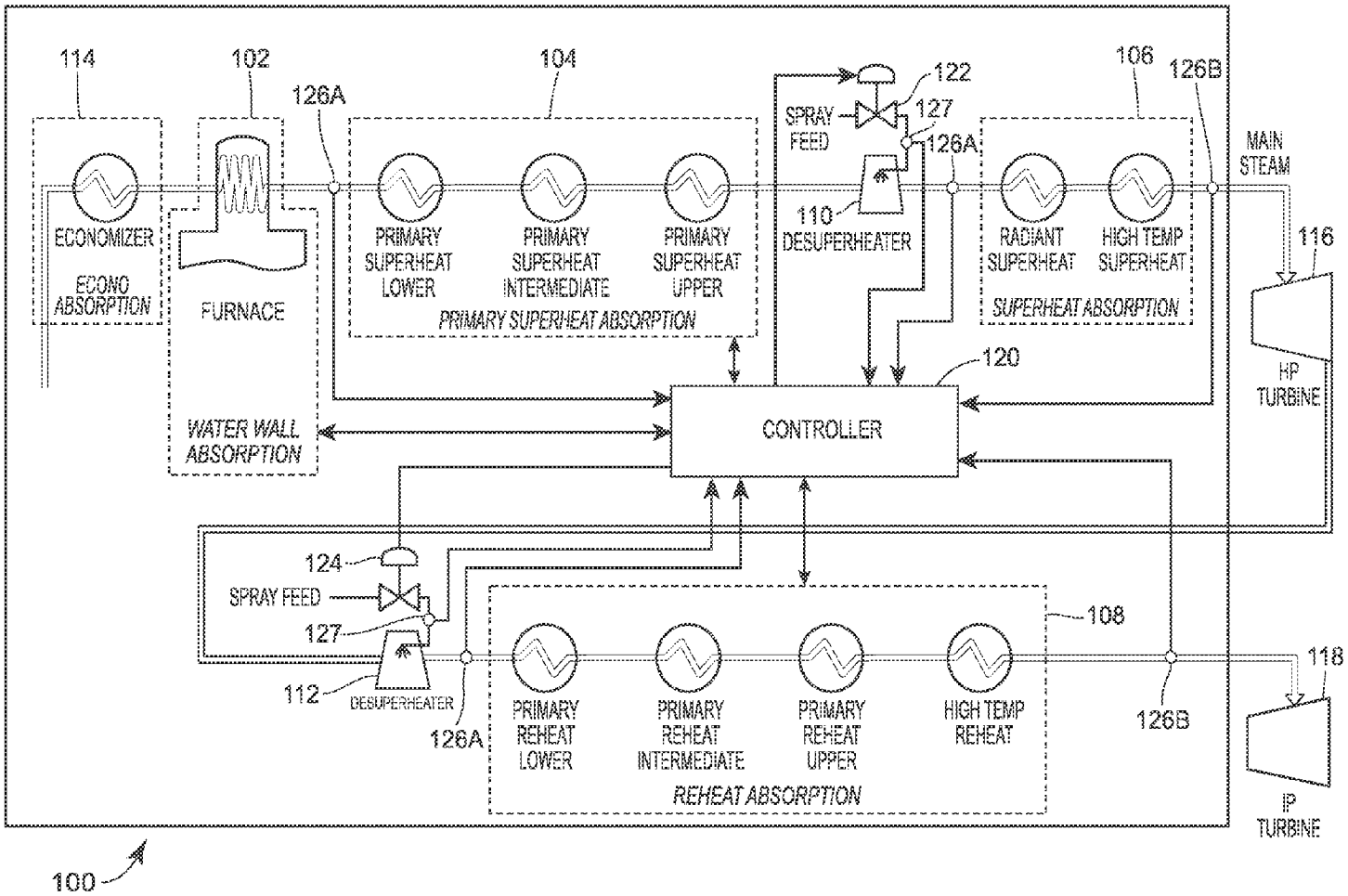
FIG. 1 illustrates a block diagram of a typical boiler steam cycle for a typical set of steam powered turbines, the boiler steam cycle having a superheater section and a reheater section.

FIG. 1 illustrates a block diagram of a once-through boiler steam cycle for a typical boiler 100 that may be used, for example, in a thermal power plant. The boiler 100 may include various sections through which steam or water flows in various forms such as superheated steam, reheated steam, etc. While the boiler 100 illustrated in FIG. 1 has various boiler sections situated horizontally, in an actual implementation, one or more of these sections may be positioned vertically with respect to one another, especially because flue gases heating the steam in various different boiler sections, such as a water wall absorption section, rise vertically (or, spiral vertically).

In any event, as illustrated in FIG. 1, the boiler 100 includes a furnace and a primary water wall absorption section 102, a primary superheater absorption section 104, a superheater absorption section 106 and a reheater section 108. Additionally, the boiler 100 may include one or more desuperheaters or sprayer sections 110 and 112 and an economizer section 114. During operation, the main steam generated by the boiler 100 and output by the superheater section 106 is used to drive a high pressure (HP) turbine 116 and the hot reheated steam coming from the reheater section 108 is used to drive an intermediate pressure (IP) turbine 118. Typically, the boiler 100 may also be used to drive a low pressure (LP) turbine, which is not shown in FIG. 1.

The water wall absorption section 102, which is primarily responsible for generating steam, includes a number of pipes through which water or steam from the economizer section 114 is heated in the furnace. Of course, feedwater coming into the water wall absorption section 102 may be pumped through the economizer section 114 and this water absorbs a large amount of heat when in the water wall absorption section 102. The steam or water provided at output of the water wall absorption section 102 is fed to the primary superheater absorption section 104, and then to the superheater absorption section 106, which together raise the steam temperature to very high levels. The main steam output from the superheater absorption section 106 drives the high pressure turbine 116 to generate electricity.

Once the main steam drives the high pressure turbine 116, the steam is routed to the reheater absorption section 108, and the hot reheated steam output from the reheater absorption section 108 is used to drive the intermediate pressure turbine 118. The spray sections 110 and 112 may be used to control the final steam temperature at the inputs of the turbines 116 and 118 to be at desired setpoints. Finally, the steam from the intermediate pressure turbine 118 may be fed through a low pressure turbine system (not shown here), to a steam condenser (not shown here), where the steam is condensed to a liquid form, and the cycle begins again with various boiler feed pumps pumping the feedwater through a cascade of feedwater heater trains and then an economizer for the next cycle. The economizer section 114 is located in the flow of hot exhaust gases exiting from the boiler and uses the hot gases to transfer additional heat to the feedwater before the feedwater enters the water wall absorption section 102.

As illustrated in FIG. 1, a controller or controller unit 120 is communicatively coupled to the furnace within the water wall section 102 and to valves 122 and 124 which control the amount of water provided to sprayers in the spray sections 110 and 112. The controller 120 is also coupled to various sensors, including intermediate temperature sensors 126A located at the outputs of the water wall section 102, the desuperheater section 110, and the desuperheater section 112; output temperature sensors 126B located at the second superheater section 106 and the reheater section 108; and flow sensors 127 at the outputs of the valves 122 and 124. The controller 120 also receives other inputs including the firing rate, a load signal (typically referred to as a feed forward signal) which is indicative of and/or a derivative of an actual or desired load of the power plant, as well as signals indicative of settings or features of the boiler including, for example, damper settings, burner tilt positions, etc. The controller 120 may generate and send other control signals to the various boiler and furnace sections of the system and may receive other measurements, such as valve positions, measured spray flows, other temperature measurements, etc. While not specifically illustrated as such in FIG. 1, the controller or controller unit 120 could include separate sections, routines and/or control devices for controlling the superheater and the reheater sections of the boiler system.

Figure 2:
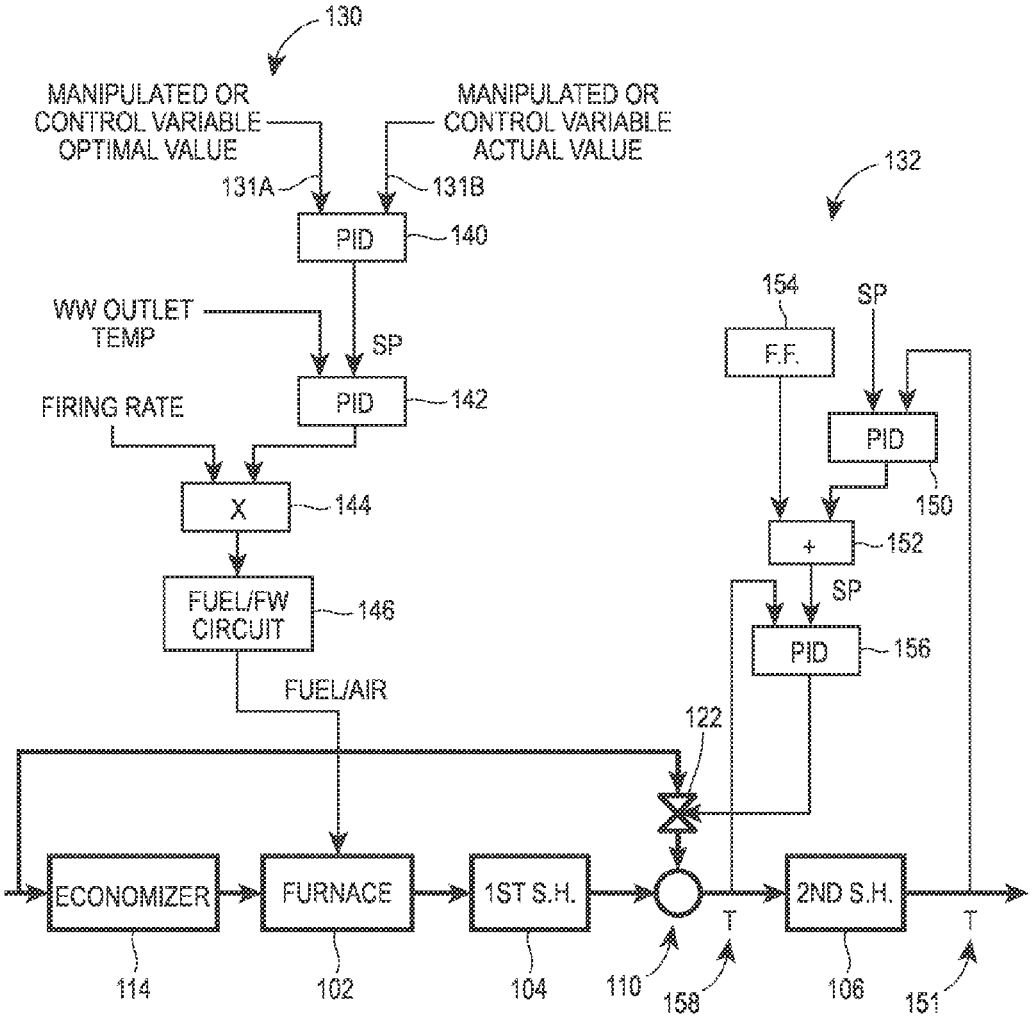
FIG. 2 (PRIOR ART)
FIG. 2 illustrates a schematic diagram of a prior art manner of controlling a superheater section of a boiler steam cycle for a steam powered turbine, such as that of FIG. 1.

FIG. 2 is a schematic diagram 128 showing the various sections of the boiler system 100 of FIG. 1 and illustrating a typical manner in which control is currently performed in boilers in the prior art. In particular, the diagram 128 illustrates the economizer 114, the primary furnace or water wall section 102, the first superheater section 104, the second superheater section 106 and the spray section 110 of FIG. 1. In this case, the spray water provided to the superheater spray section 110 is tapped from the feed line into the economizer 114. FIG. 2 also illustrates two PID-based control loops 130 and 132 which may be implemented by the controller 120 of FIG. 1 or by other DCS controllers to control the fuel and feedwater operation of the furnace 102 to affect the output steam temperature 151 delivered by the boiler system to the turbine.

In particular, the control loop 130 includes a first control block 140, illustrated in the form of a proportional-integral-derivative (PID) control block, which uses, as a primary input, a setpoint 131A in the form of a factor or signal corresponding to a desired or optimal value of a control variable or a manipulated variable 131A used to control or associated with a section of the boiler system 100. The desired value 131A may correspond to, for example, a desired superheater spray setpoint or an optimal burner tilt position. In other cases, the desired or optimal value 131A may correspond to a damper position of a damper within the boiler system 100, a position of a spray valve, an amount of spray, some other control, manipulated or disturbance variable or combination thereof that is used to control or is associated with the section of the boiler system 100. Generally, the setpoint 131A may correspond to a control variable or a manipulated variable of the boiler system 100, and may be typically set by a user or an operator.

The control block 140 compares the setpoint 131A to a measure of the actual control or manipulated variable 131B currently being used to produce a desired output value. For clarity of discussion, FIG. 2 illustrates an embodiment where the setpoint 131A at the control block 140 corresponds to a desired superheater spray. The control block 140 compares the superheater spray setpoint to a measure of the actual superheater spray amount (e.g., superheater spray flow) currently being used to produce a desired water wall outlet temperature setpoint. The water wall output temperature setpoint is indicative of the desired water wall outlet temperature needed to control the temperature at the output of the second superheater 106 (reference 151) to be at the desired turbine input temperature, using the amount of spray flow specified by the desired superheater spray setpoint. This water wall outlet temperature setpoint is provided to a second control block 142 (also illustrated as a PID control block), which compares the water wall outlet temperature setpoint to a signal indicative of the measured water wall steam temperature and operates to produce a feed control signal. The feed control signal is then scaled in a multiplier block 144, for example, based on the firing rate (which is indicative of or based on the power demand). The output of the multiplier block 144 is provided as a control input to a fuel/feedwater circuit 146, which operates to control the firing rate to feedwater ratio of the furnace/boiler combination or to control the fuel to air mixture provided to the primary furnace section 102.

The operation of the superheater spray section 110 is controlled by the control loop 132. The control loop 132 includes a control block 150 (illustrated in the form of a PID control block) which compares a temperature setpoint for the temperature of the steam at the input to the turbine 116 (typically fixed or tightly set based on operational characteristics of the turbine 116) to a measurement of the actual temperature of the steam at the input of the turbine 116 (reference 151) to produce an output control signal based on the difference between the two. The output of the control block 150 is provided to a summer block 152 which adds the control signal from the control block 150 to a feed forward signal which is developed by a block 154 as, for example, a derivative of a load signal corresponding to an actual or desired load generated by the turbine 116. The output of the summer block 152 is then provided as a setpoint to a further control block 156 (again illustrated as a PID control block), which setpoint indicates the desired temperature at the input to the second superheater section 106 (reference 158). The control block 156 compares the setpoint from the block 152 to an intermediate measurement of the steam temperature 158 at the output of the superheater spray section 110, and, based on the difference between the two, produces a control signal to control the valve 122 which controls the amount of the spray provided in the superheater spray section 110. As used herein, an "intermediate" measurement or value of a control variable or a manipulated variable is determined at a location that is upstream of a location at which a dependent process variable that is desired to be controlled is measured. For example, as illustrated in FIG. 2, the "intermediate" steam temperature 158 is determined at a location that is upstream of the location at which the output steam temperature 151 is measured (e.g., the "intermediate steam temperature" or the "temperature of intermediate steam" 158 is determined at a location that is further away from the turbine 116 than output steam temperature 151).

Thus, as seen from the PID-based control loops 130 and 132 of FIG. 2, the operation of the furnace 102 is directly controlled as a function of the desired superheater spray 131A, the intermediate temperature measurement 158, and the output steam temperature 151. In particular, the control loop 132 operates to keep the temperature of the steam at the input of the turbine 116 (reference 151) at a setpoint by controlling the operation of the superheater spray section 110, and the control loop 130 controls the operation of the fuel provided to and burned within the furnace 102 to keep the superheater spray at a predetermined setpoint (to thereby attempt to keep the superheater spray operation or spray amount at an "optimum" level).

Of course, while the embodiment discussed uses the superheater spray flow amount as an input to the control loop 130, one or more other control related signals or factors could be used as well or in other circumstances as an input to the control loop 130 for developing one or more output control signals to control the operation of the boiler/furnace, and thereby provide steam temperature control. For example, the control block 140 may compare the actual burner tilt positions with an optimal burner tilt position, which may come from off-line unit characterization (especially for boiler systems manufactured by Combustion Engineering) or a separate on-line optimization program or other source. In another example with a different boiler design configuration, if flue gas by-pass damper(s) are used for primary reheater steam temperature control, then the signals indicative of the desired (or optimal) and actual burner tilt positions in the control loop 130 may be replaced or supplemented with signals indicative of or related to the desired (or optimal) and actual damper positions.

Additionally, while the control loop 130 of FIG. 2 is illustrated as producing a control signal for controlling the fuel/air mixture of the fuel provided to the furnace 102, the control loop 130 could produce other types or kinds of control signals to control the operation of the furnace such as the fuel to feedwater ratio used to provide fuel and feedwater to the furnace/boiler combination, the amount or quantity or type of fuel used in or provided to the furnace, etc. Still further, the control block 140 may use some disturbance variable as its input even if that variable itself is not used to directly control the dependent variable (in the above embodiment, the desired output steam temperature 151).

Furthermore, as seen from the control loops 130 and 132 of FIG. 2, the control of the operation of the furnace in both control loops 130 and 132 is reactionary. That is, the control loops 130 and 132 (or portions thereof) react to initiate a change only after a difference between a setpoint and an actual value is detected. For example, only after the control block 150 detects a difference between the output steam temperature 151 and a desired setpoint does the control block 150 produce a control signal to the summer 152, and only after the control block 140 detects a difference between a desired and an actual value of a disturbance or manipulated variable does the control block 140 produce a control signal corresponding to a water wall outlet temperature setpoint to the control block 142. This reactionary control response can result in large output swings that cause stress on the boiler system, thereby shortening the life of tubes, spray control valves, and other components of the system, and in particular when the reactionary control is coupled with changing boiler operating conditions.

Figure 3:
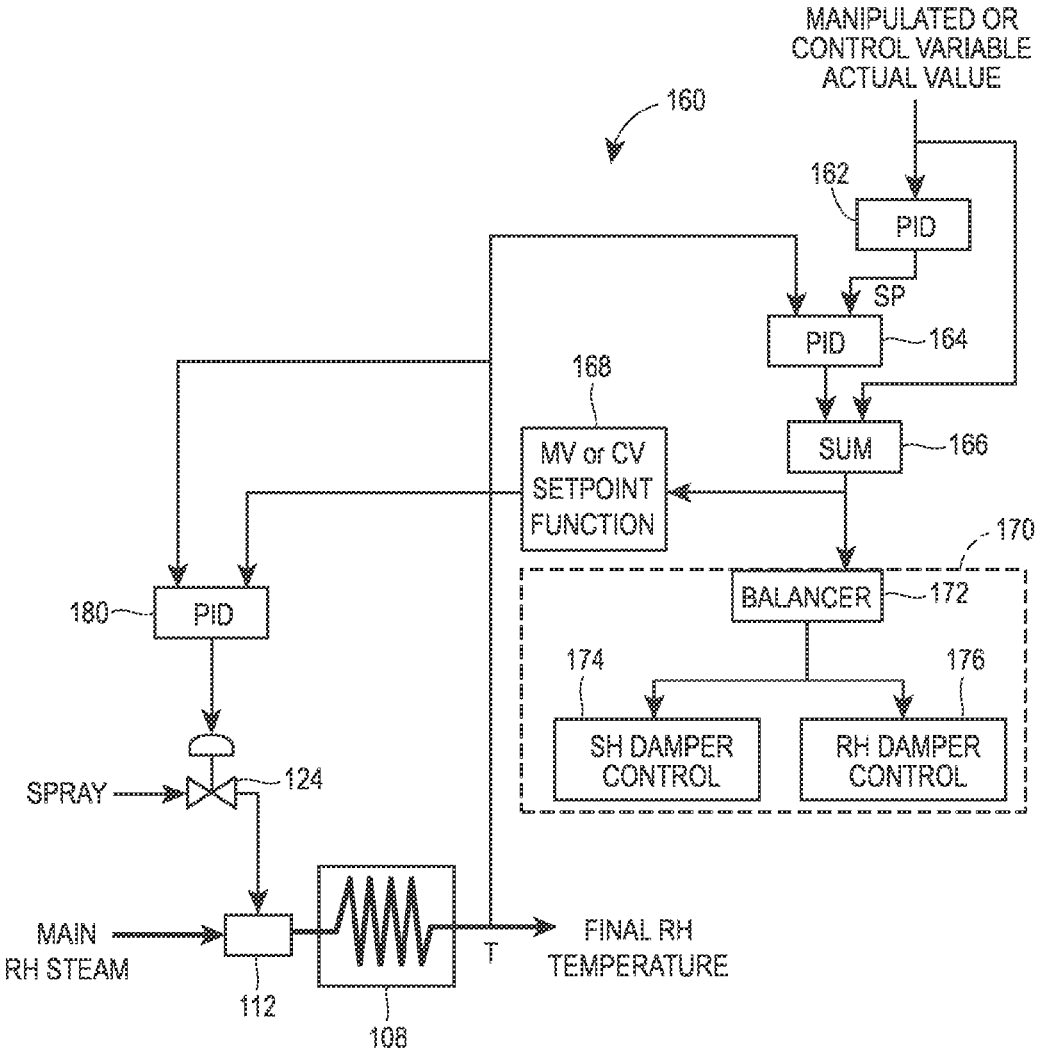
FIG. 3 (PRIOR ART)
FIG. 3 illustrates a schematic diagram of a prior art manner of controlling a reheater section of a boiler steam cycle for a steam powered turbine system, such as that of FIG. 1.

FIG. 3 illustrates a typical (prior art) control loop 160 used in a reheater section 108 of a steam turbine power generation system, which may be implemented by, for example, the controller or controller unit 120 of FIG. 1. Here, a control block 161 may operate on a signal corresponding to an actual value of a control variable or a manipulated variable 162 used to control or associated with the boiler system 100. For clarity of discussion, FIG. 3 illustrates an embodiment of the control loop 160 in which the input 162 corresponds to steam flow (which is typically determined by load demands). The control block 161 produces a temperature setpoint for the temperature of the steam being input to the turbine 118 as a function of the steam flow. A control block 164 (illustrated as a PID control block) compares this temperature setpoint to a measurement of the actual steam temperature 163 at the output of the reheater section 108 to produce a control signal as a result of the difference between these two temperatures. A block 166 then sums this control signal with a measure of the steam flow and the output of the block 166 is provided to a spray setpoint unit or block 168 as well as to a balancer unit 170.

The balancer unit 170 includes a balancer 172 which provides control signals to a superheater damper control unit 174 as well as to a reheater damper control unit 176 which operate to control the flue gas dampers in the various superheater and the reheater sections of the boiler. As will be understood, the flue gas damper control units 174 and 176 alter or change the damper settings to control the amount of flue gas from the furnace which is diverted to each of the superheater and reheater sections of the boilers. Thus, the control units 174 and 176 thereby control or balance the amount of energy provided to each of the superheater and reheater sections of the boiler. As a result, the balancer unit 170 is the primary control provided on the reheater section 108 to control the amount of energy or heat generated within the furnace 102 that is used in the operation of the reheater section 108 of the boiler system of FIG. 1. Of course, the operation of the dampers provided by the balancer unit 170 controls the ratio or relative amounts of energy or heat provided to the reheater section 108 and the superheater sections 104 and 106, as diverting more flue gas to one section typically reduces the amount of flue gas provided to the other section. Still further, while the balancer unit 170 is illustrated in FIG. 3 as performing damper control, the balancer 170 can also provide control using furnace burner tilt position or in some cases, both.

Because of temporary or short term fluctuations in the steam temperature, and the fact that the operation of the balancer unit 170 is tied in with operation of the superheater sections 104 and 106 as well as the reheater section 108, the balancer unit 170 may not be able to provide complete control of the steam temperature 163 at the output of the reheater section 108, to assure that the desired steam temperature at this location 161 is attained. As a result, secondary control of the steam temperature 163 at the input of the turbine 118 is provided by the operation of the reheater spray section 112.

In particular, control of the reheater spray section 112 is provided by the operation of the spray setpoint unit 168 and a control block 180. Here, the spray setpoint unit 168 determines a reheater spray setpoint based on a number of factors, taking into account the operation of the balancer unit 170, in well known manners. Typically, however, the spray setpoint unit 168 is configured to operate the reheater spray section 112 only when the operation of the balancer unit 170 cannot provide enough or adequate control of the steam temperature 161 at the input of the turbine 118. In any event, the reheater spray setpoint is provided as a setpoint to the control block 180 (again illustrated as a PID control block) which compares this setpoint with a measurement of the actual steam temperature 161 at the output of the reheater section 108 and produces a control signal based on the difference between these two signals, and the control signal is used to control the reheater spray valve 124. As is known, the reheater spray valve 124 then operates to provide a controlled amount of reheater spray to perform further or additional control of the steam temperature at output of the reheater 108.

In some embodiments, the control of the reheater spray section 112 may be performed using a similar control scheme as discussed with respect to FIG. 2. For example, the use of a reheater section variable 162 as an input to the control loop 160 of FIG. 3 is not limited to a manipulated variable used to actually control the reheater section in a particular instance. Thus, it may be possible to use a reheater manipulated variable 162 that is not actually used to control the reheater section 108 as an input to the control loop 160, or some other control or disturbance variable of the boiler system 100.

Similar to the PID-based control loops 130 and 132 of FIG. 2, the PID-based control loop 160 is also reactionary. That is, the PID-based control loop 160 (or portions thereof) reacts to initiate a change only after a detected difference or error between a setpoint and an actual value is detected. For example, only after the control block 164 detects a difference between the reheater output steam temperature 163 and the desired setpoint generated by the control block 161 does the control block 164 produce a control signal to the summer 166, and only after the control block 180 detects a difference between the reheater output temperature 163 and the setpoint determined at the block 168 does the control block 180 produce a control signal to the spray valve 124. This reactionary control response coupled with changing boiler operating conditions can result in large output swings that may shorten the life of tubes, spray control valves, and other components of the system.

Figure 4:
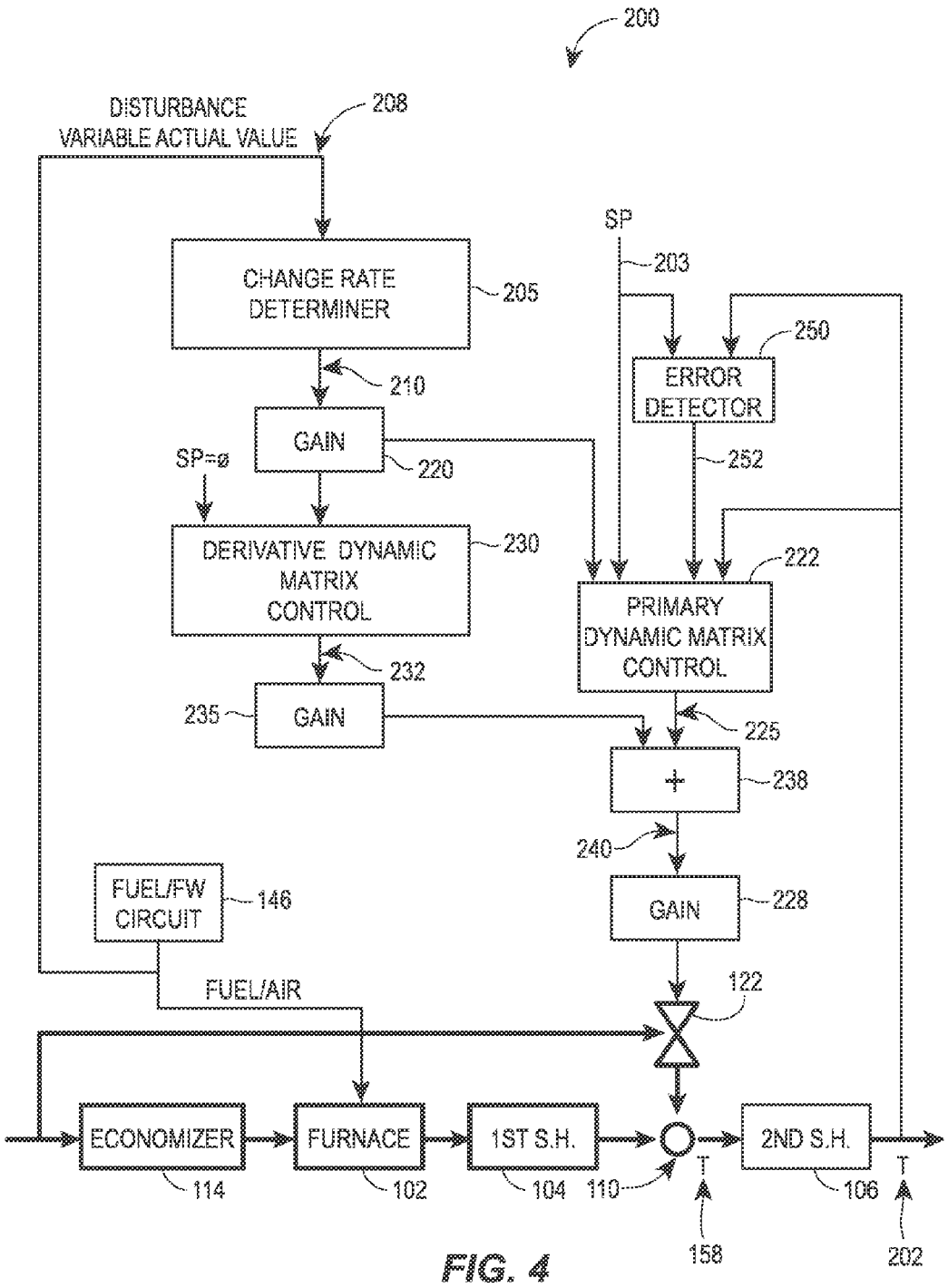
FIG. 4 illustrates a schematic diagram of a manner of controlling the boiler steam cycle of the steam powered turbines of FIG. 1 in a manner which helps to optimize efficiency of the system.

FIG. 4 illustrates an embodiment of a control system or control scheme 200 for controlling the steam generating boiler system 100. The control system 200 may control at least a portion of the boiler system 100 such as a control variable or other dependent process variable of the boiler system 100. In the example shown in FIG. 4, the control system 200 controls a temperature of output steam 202 delivered from the boiler system 100 to the turbine 116, but in other embodiments, the control scheme 200 may additionally or alternatively control another portion of the boiler system 100 (e.g., an intermediate portion such as a temperature of steam entering the second superheater section 106, or a system output, an output parameter, or an output control variable such as a pressure of the output steam at the turbine 118). In some embodiments, multiple control schemes 200 may control different output parameters.

The control system or control scheme 200 may be performed in or may be communicatively coupled with the controller or controller unit 120 of the boiler system 100. For example, in some embodiments, at least a portion of the control system or control scheme 200 may be included in the controller 120. In some embodiments, the entire control system or control scheme 200 may be included in the controller 120.

Indeed, the control system 200 of FIG. 4 may be a replacement for the PID-based control loops 130 and 132 of FIG. 2. However, instead of being reactionary like the control loops 130 and 132 (e.g., where a control adjustment is not initiated until after a difference or error is detected between the portion of the boiler system 100 that is desired to be controlled and a corresponding setpoint), the control scheme 200 is at least partially feed forward in nature, so that the control adjustment is initiated before a difference or error at the portion of the boiler system 100 is detected. Specifically, the control system or scheme 200 may be based on a rate of change of one or more disturbance variables that affect the portion of the boiler system 100 that is desired to be controlled. A dynamic matrix control (DMC) block may receive the rate of change of the one or more disturbance variables at an input and may cause the process to run at an optimal point based on the rate of change. Moreover, the DMC block may continually optimize the process over time as the rate of change itself changes. Thus, as the DMC block continually estimates the best response and predictively optimizes or adjusts the process based on current inputs, the dynamic matrix control block is feed forward or predictive in nature and is able to control the process more tightly around its setpoint. Accordingly, process components are not subjected to wide swings in temperature or other such factors with the DMC-based control scheme 200. In contrast, PID-based control systems or schemes cannot predict or estimate optimizations at all, as PID-based control systems or schemes require a resultant measurement or error in the controlled variable to actually occur in order to determine any process adjustments. Consequently, PID-based control systems or schemes swing more widely from desired setpoints than the control system or scheme 200, and process components in PID-based control systems typically fail earlier due to these extremes.

In further contrast to the PID-based control loops 130 and 132 of FIG. 2, the DMC-based control system or scheme 200 does not require receiving, as an input, any intermediate or upstream value corresponding to the portion of the boiler system 100 that is desired to be controlled, such as the intermediate steam temperature 158 determined after the spray valve 122 and before the second superheater section 106. Again, as the DMC-based control system or scheme 200 is at least partially predictive, the DMC-based control system or scheme 200 does not require intermediate "checkpoints" to attempt to optimize the process, as do PID-based schemes. These differences and details of the control system 200 are described in more detail below.

In particular, the control system or scheme 200 includes a change rate determiner 205 that receives a signal corresponding to a measure of an actual disturbance variable of the control scheme 200 that currently affects a desired operation of the boiler system 100 or a desired output value of a control or dependent process variable 202 of the control scheme 200, similar to the measure of the control or manipulated variable 131B received at the control block 140 of FIG. 2. In the embodiment illustrated in FIG. 4, the desired operation of the boiler system 100 or controlled variable of the control scheme 200 is the output steam temperature 202, and the disturbance variable input to the control scheme 200 at the change rate determiner 205 is a fuel to air ratio 208 being delivered to the furnace 102. However, the input to the change rate determiner 205 may be any disturbance variable. For example, the disturbance variable of the control scheme 200 may be a manipulated variable that is used in some other control loop of the boiler system 100 other than the control scheme 200, such as a damper position. The disturbance variable of the control scheme 200 may be a control variable that is used in some other control loop of the boiler system 100 other than the control scheme 200, such as intermediate temperature 126B of FIG. 1. The disturbance variable input into the change rate determiner 205 may be considered simultaneously as a control variable of another particular control loop, and a manipulated variable of yet another control loop in the boiler system 100, such as the fuel to air ratio. The disturbance variable may be some other disturbance variable of another control loop, e.g., ambient air pressure or some other process input variable. Examples of possible disturbance variables that may be used in conjunction with the DMC-based control system or scheme 200 include, but are not limited to a furnace burner tilt position; a steam flow; an amount of soot blowing; a damper position; a power setting; a fuel to air mixture ratio of the furnace; a firing rate of the furnace; a spray flow; a water wall steam temperature; a load signal corresponding to one of a target load or an actual load of the turbine; a flow temperature; a fuel to feed water ratio; the temperature of the output steam; a quantity of fuel; a type of fuel, or some other manipulated variable, control variable, or disturbance variable. In some embodiments, the disturbance variable may be a combination of one or more control, manipulated, and/or disturbance variables.

Furthermore, although only one signal corresponding to a measure of one disturbance variable of the control system or scheme 200 is shown as being received at the change rate determiner 205, in some embodiments, one or more signals corresponding to one or more disturbance variables of the control system or scheme 200 may be received by the change rate determiner 205. However, in contrast to reference 131A of FIG. 2, it is not necessary for the change rate determiner 205 to receive a setpoint or desired/optimal value corresponding to the measured disturbance variable, e.g., in FIG. 4, it is not necessary to receive a setpoint for the fuel to air ratio 208.

Figure 5A:
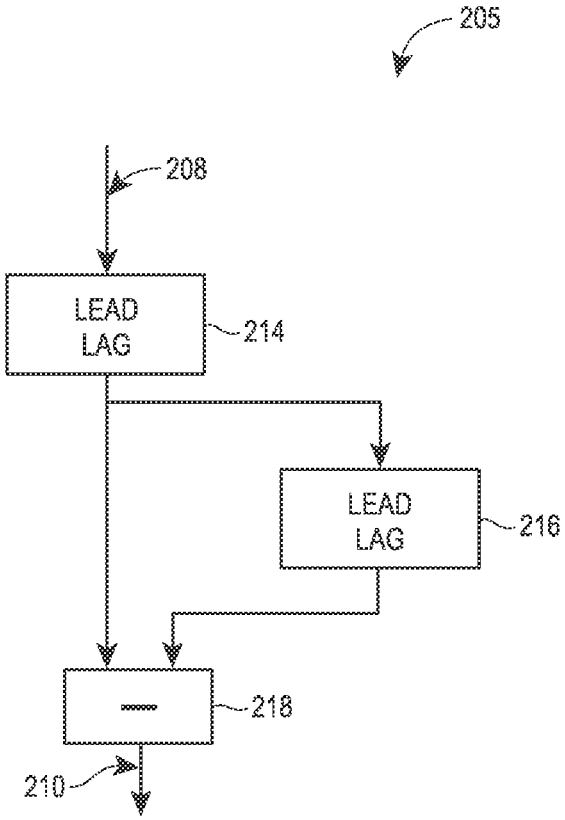
FIG. 5A illustrates an embodiment of the change rate determiner of FIG. 4.

The change rate determine 205 is configured to determine a rate of change of the disturbance variable input 208 and to generate a signal 210 corresponding to the rate of change of the input 208. FIG. 5A illustrates an example of the change rate determiner 205. In this example, the change rate determiner 205 includes at least two lead lag blocks 214 and 216 that each adds an amount of time lead or time lag to the received input 208. Using the outputs of the two lead lag blocks 214 and 216, the change rate determiner 205 determines a difference between two measures of the signal 208 at two different points in time, and accordingly, determines a slope or a rate of change of the signal 208.

In particular, the signal 208 corresponding to the measure of the disturbance variable may be received at an input of the first lead lag block 214 that may add a time delay. An output generated by the first lead lag block 214 may be received at a first input of a difference block 218. The output of the first lead lag block 214 may also be received at an input of the second lead lag block 216 that may add an additional time delay that may be same as or different than the time delay added by the first lead lag block 214. The output of the second lead lag block 216 may be received at a second input of the difference block 218. The difference block 218 may determine a difference between the outputs of the lead lag blocks 214 and 216, and, by using the time delays of the lead lag blocks 214, 216, may determine the slope or the rate of change of the disturbance variable 208. The difference block 218 may generate a signal 210 corresponding to a rate of change of the disturbance variable 208. In some embodiments, one or both of the lead lag blocks 214, 216 may be adjustable to vary their respective time delay. For instance, for a disturbance input 208 that changes more slowly over time, a time delay at one or both lead lag blocks 214, 216 may be increased. In some embodiments, the change rate determiner 205 may collect more than two measures of the signal 208 in order to more accurately calculate the slope or rate of change. Of course, FIG. 5A is only one example of the change rate determiner 205 of FIG. 4, and other examples may be possible.

Turning back to FIG. 4, the signal 210 corresponding to the rate of change of the disturbance variable may be received by a gain block or a gain adjustor 220 that introduces gain to the signal 210. The gain may be amplificatory or the gain may be fractional. The amount of gain introduced by the gain block 220 may be manually or automatically selected. In some embodiments, the gain block 220 may be omitted.

The signal 210 corresponding to the rate of change of the disturbance variable of the control system or scheme 200 (including any desired gain introduced by the optional gain block 220) may be received at a dynamic matrix control (DMC) block 222. The DMC block 222 may also receive, as inputs, a measure of a current or actual value of the portion of the boiler system 100 to be controlled (e.g., the control or controlled variable of the control system or scheme 200; in the example of FIG. 4, the temperature 202 of the steam output) and a corresponding setpoint 203. The dynamic matrix control block 222 may perform model predictive control based on the received inputs to generate a control output signal. Note that unlike the PID-based control loops 130 and 132 of FIG. 2, the DMC block 222 does not need to receive any signals corresponding to intermediate measures of the portion of the boiler system 100 to be controlled, such as the intermediate steam temperature 158. However, such signals may be used as inputs to the DMC block 222 if desired, for instance, when a signal to an intermediate measure is input into the change rate determiner 205 and the change rate determiner 205 generates a signal corresponding to the rate of change of the intermediate measure. Furthermore, although not illustrated in FIG. 4, the DMC block 222 may also receive other inputs in addition to the signal 210 corresponding to the rate of change, the signal corresponding to an actual value of the controlled variable (e.g., reference 202), and its setpoint 203. For example, the DMC block 222 may receive signals corresponding to zero or more disturbance variables other than the signal 210 corresponding to the rate of change.

Generally speaking, the model predictive control performed by the DMC block 222 is a multiple-input-single-output (MISO) control strategy in which the effects of changing each of a number of process inputs on each of a number of process outputs is measured and these measured responses are then used to create a model of the process. In some cases, though, a multiple-input-multiple-output (MIMO) control strategy may be employed. Whether MISO or MIMO, the model of the process is inverted mathematically and is then used to control the process output or outputs based on changes made to the process inputs. In some cases, the process model includes or is developed from a process output response curve for each of the process inputs and these curves may be created based on a series of, for example, pseudo-random step changes delivered to each of the process inputs. These response curves can be used to model the process in known manners. Model predictive control is known in the art and, as a result, the specifics thereof will not be described herein. However, model predictive control is described generally in Qin, S. Joe and Thomas A. Badgwell, "An Overview of Industrial Model Predictive Control Technology," *AIChE Conference,* 1996.

Moreover, the generation and use of advanced control routines such as MPC control routines may be integrated into the configuration process for a controller for the steam generating boiler system. For example, Wojsznis et al., U.S. Pat. No. 6,445,963 entitled "Integrated Advanced Control Blocks in Process Control Systems," the disclosure of which is hereby expressly incorporated by reference herein, discloses a method of generating an advanced control block such as an advanced controller (e.g., an MPC controller or a neural network controller) using data collected from the process plant when configuring the process plant. More particularly, U.S. Pat. No. 6,445,963 discloses a configuration system that creates an advanced multiple-input-multiple-output control block within a process control system in a manner that is integrated with the creation of and downloading of other control blocks using a particular control paradigm, such as the Fieldbus paradigm. In this case, the advanced control block is initiated by creating a control block (such as the DMC block 222) having desired inputs and outputs to be connected to process outputs and inputs, respectively, for controlling a process such as a process used in a steam generating boiler system. The control block includes a data collection routine and a wavefolin generator associated therewith and may have control logic that is not tuned or otherwise undeveloped because this logic is missing tuning parameters, matrix coefficients or other control parameters necessary to be implemented. The control block is placed within the process control system with the defined inputs and outputs communicatively coupled within the control system in the manner that these inputs and outputs would be connected if the advanced control block was being used to control the process. Next, during a test procedure, the control block systematically upsets each of the process inputs via the control block outputs using waveforms generated by the waveform generator specifically designed for use in developing a process model. Then, via the control block inputs, the control block coordinates the collection of data pertaining to the response of each of the process outputs to each of the generated waveforms delivered to each of the process inputs. This data may, for example, be sent to a data historian to be stored. After sufficient data has been collected for each of the process input/output pairs, a process modeling procedure is run in which one or more process models are generated from the collected data using, for example, any known or desired model generation or determination routine. As part of this model generation or determination routine, a model parameter determination routine may develop the model parameters, e.g., matrix coefficients, dead time, gain, time constants, etc. needed by the control logic to be used to control the process. The model generation routine or the process model creation software may generate different types of models, including non-parametric models, such as finite impulse response (FIR) models, and parametric models, such as auto-regressive with external inputs (ARX) models. The control logic parameters and, if needed, the process model, are then downloaded to the control block to complete formation of the advanced control block so that the advanced control block, with the model parameters and/or the process model therein, can be used to control the process during run-time. When desired, the model stored in the control block may be re-determined, changed, or updated.

In the example illustrated by FIG. 4, the inputs to the dynamic matrix control block 222 include the signal 210 corresponding to the rate of change of the one or more disturbance variables of the control scheme 200 (such as one or more of the previously discussed disturbance variables), a signal corresponding to a measure of an actual value or level of the controlled output 202, and a setpoint 203 corresponding to a desired or optimal value of the controlled output. Typically (but not necessarily), the setpoint 203 is deter mined by a user or operator of the steam generating boiler system 100. The DMC block 222 may use a dynamic matrix control routine to predict an optimal response based on the inputs and a stored model (typically parametric, but in some cases may be non-parametric), and the DMC block 222 may generate, based on the optimal response, a control signal 225 for controlling a field device. Upon reception of the signal 225 generated by the DMC block 222, the field device may adjust its operation based on control signal 225 received from the DMC block 222 and influence the output towards the desired or optimal value. In this manner, the control scheme 200 may feed forward the rate of change 210 of one or more disturbance variables, and may provide advanced correction prior to any difference or error occurring in the output value or level. Furthermore, as the rate of change of the one or more disturbance variables 210 changes, the DMC block 222 predicts a subsequent optimal response based on the changed inputs 210 and generates a corresponding updated control signal 225.

In the example particularly illustrated in FIG. 4, the input to the change rate determiner 205 is a fuel to air ratio 208 being delivered to the furnace 102, the portion of the steam generating boiler system 100 that is controlled by the control scheme 200 is the output steam temperature 202, and the control scheme 200 controls the output steam temperature 202 by adjusting the spray valve 122. Accordingly, a dynamic matrix control routine of the DMC block 222 uses the signal 210 corresponding to the rate of change of the fuel to air ratio 208 generated by the change rate determiner 205, a signal corresponding to a measure of an actual output steam temperature 202, a desired output steam temperature or setpoint 203, and a parametric model to determine a control signal 225 for the spray valve 122. The parametric model used by the DMC block 222 may identify exact relationships between the input values and control of the spray valve 122 (rather than just a direction as in PID control). The DMC block 222 generates the control signal 225, and upon its reception, the spray valve 122 adjusts an amount of spray flow based on the control signal 225, thus influencing the output steam temperature 202 towards the desired temperature. In this feed forward manner, the control system 200 controls the spray valve 122, and consequently the output steam temperature 202 based on a rate of change of the fuel to air ratio 208. If the fuel to air ratio 208 subsequently changes, then the DMC block 222 may use the updated fuel to air ratio 208, the parametric model, and in some cases, previous input values, to determine a subsequent optimal response. A subsequent control signal 225 may be generated and sent to the spray valve 122.

The control signal 225 generated by the DMC block 222 may be received by a gain block or gain adjustor 228 (e.g., a summer gain adjustor) that introduces gain to the control signal 225 prior to its delivery to the field device 122. In some cases, the gain may be amplificatory. In some cases, the gain may be fractional. The amount of gain introduced by the gain block 228 may be manually or automatically selected. In some embodiments, the gain block 228 may be omitted.

Steam generating boiler systems by their nature, however, generally respond somewhat slowly to control, in part due to the large volumes of water and steam that move through the system. To help shorten the response time, the control scheme 200 may include a derivative dynamic matrix control (DMC) block 230 in addition to the primary dynamic matrix control block 222. The derivative DMC block 230 may use a stored model (either parametric or a non-parametric) and a derivative dynamic matrix control routine to determine an amount of boost by which to amplify or modify the control signal 225 based on the rate of change or derivative of the disturbance variable received at an input of the derivative DMC block 230. In some cases, the control signal 225 may also be based on a desired weighting of the disturbance variable, and/or the rate of change thereof. For example, a particular disturbance variable may be more heavily weighted so as to have more influence on the controlled output (e.g., on the reference 202). Typically, the model stored in the derivative DMC block 230 (e.g., the derivative model) may be different than the model stored in the primary DMC block 222 (e.g., the primary model), as the DMC blocks 222 and 230 each receive a different set of inputs to generate different outputs. The derivative DMC block 230 may generate at its output a boost signal or a derivative signal 232 corresponding to the amount of boost.

A summer block 238 may receive the boost signal 232 generated by the derivative DMC block 230 (including any desired gain introduced by the optional gain block 235) and the control signal 225 generated by the primary DMC block 222. The summer block 238 may combine the control signal 225 and the boost signal 232 to generate a summer output control signal 240 to control a field device, such as the spray valve 122. For example, the summer block 238 may add the two input signals 225 and 232, or may amplify the control signal 225 by the boost signal 232 in some other manner. The summer output control signal 240 may be delivered to the field device to control the field device. In some embodiments, optional gain may be introduced to the summer output control signal 240 by the gain block 228, in a manner such as previously discussed for the gain block 228.

Upon reception of the summer output control signal 240, a field device such as the spray valve 122 may be controlled so that the response time of the boiler system 100 is shorter than a response time when the field device is controlled by the control signal 225 alone so as to move the portion of the boiler system that is desired to be controlled more quickly to the desired operating value or level. For example, if the rate of change of the disturbance variable is slower, the boiler system 100 can afford more time to respond to the change, and the derivative DMC block 230 would generate a boost signal corresponding to a lower boost to be combined with the control output of the primary DMC block 230. If the rate of change is faster, the boiler system 100 would have to respond more quickly and the derivative DMC block 230 would generate a boost signal corresponding to a larger boost to be combined with the control output of the primary DMC block 230.

In the example illustrated by FIG. 4, the derivative DMC block 230 may receive, from the change rate determiner 205, the signal 210 corresponding to the rate of change of the fuel to air ratio 208, including, any desired gain introduced by the optional gain block 220. Based on the signal 210 and a parametric model stored in the derivative DMC block 230, the derivative DMC block 230 may determine (via, for example, a derivative dynamic matrix control routine) an amount of boost that is to be combined with the control signal 225 generated by the primary DMC block 222, and may generate a corresponding boost signal 232. The boost signal 232 generated by the derivative DMC block 230 may be received by a gain block or gain (e.g., a derivative or boost gain adjustor) 235 that introduces gain to the boost signal 232. The gain may be amplificatory or fractional, and an amount of gain introduced by the gain block 235 may be manually or automatically selected. In some embodiments, the gain block 235 may be omitted.

Although not illustrated, various embodiments of the control system or scheme 200 are possible. For example, the derivative DMC block 230, its corresponding gain block 235, and the summer block 238 may be optional. In particular, in some faster responding systems, the derivative DMC block 230, the gain block 235 and the summer block 238 may be omitted. In some embodiments, one or all of the gain blocks 220, 228 and 235 may be omitted. In some embodiments, a single change rate determiner 205 may receive one or more signals corresponding to multiple disturbance variables, and may deliver a single signal 210 corresponding to rate(s) of change to the primary DMC block 222. In some embodiments, multiple change rate determiners 205 may each receive one or more signals corresponding to different disturbance variables, and the primary DMC block 222 may receive multiple signals 210 from the multiple change rate determiners 205. In the embodiments including multiple change rate determiners 205, each of the multiple change rate determiners 205 may be in connection with a different corresponding derivative DMC block 230, and the multiple derivative DMC blocks 230 may each provide their respective boost signals 232 to the summer block 238. In some embodiments, the multiple change rate determiners 205 may each provide their respective boost outputs 210 to a single derivative DMC block 230. Of course, other embodiments of the control system 200 may be possible.

Furthermore, as the steam generating boiler system 100 generally includes multiple field devices, embodiments of the control system or scheme 200 may support the multiple field devices. For example, a different control system 200 may correspond to each of the multiple field devices, so that each different field device may be controlled by a different change rate determiner 205, a different primary DMC block 222, and a different (optional) derivative DMC block 230. That is, multiple instances of the control system 200 may be included in the boiler system 100, with each of the multiple instances corresponding to a different field device. In some embodiments of the boiler system 100, at least a portion of the control scheme 200 may service multiple field devices. For example, a single change rate determiner 205 may service multiple field devices, such as multiple spray valves.

In an illustrative scenario, if more than one spray valve is desired to be controlled based on the rate of change of fuel to air ratio, a single change rate determiner 205 may generate a signal 210 corresponding to the rate of change of fuel to air ratio and may deliver the signal 210 to different primary DMC blocks 222 corresponding to the different spray valves. In another example, a single primary DMC block 222 may control all spray valves in a portion of or the entire boiler system 100. In other examples, a single derivative DMC block 230 may deliver a boost signal 232 to multiple primary DMC blocks 222, where each of the multiple primary DMC blocks 222 provides its generated control signal 225 to a different field device. Of course, other embodiments of the control system or scheme 200 to control multiple field devices may be possible.

In some embodiments, the control system or scheme 200 and/or the controller unit 120 may be dynamically tuned. For example, the control system or scheme 200 and/or the controller unit 120 may be dynamically tuned by using an error detector unit or block 250. In particular, the error detector unit may detect the presence of an error or discrepancy between the desired value 203 of an output parameter and an actual value 202 of the output parameter. The error detector unit 250 may receive, at a first input, a signal corresponding to the output parameter 202 (in this example, the temperature of the output steam 202). At a second input, the error detector unit 250 may receive a signal corresponding to the setpoint 203 of the output parameter 202. The error detector unit 250 may determine a magnitude of a difference between the signals received at the first and the second inputs, and may provide an output signal 252 indicative of the magnitude of the difference to the primary dynamic matrix control block 222.

The DMC block 222 may receive a signal corresponding to the rate of change of the disturbance variable 210 at a third input. As previously discussed, the signal corresponding to the rate of change of the disturbance variable 210 may or may not be modified by the gain block 220. The DMC block 222 may adjust the signal corresponding to the rate of change of the DV 210 based on the output signal 252 generated by the error detection unit 250 (e.g., based on the magnitude of the difference between the setpoint 203 and the actual level of the output parameter 202). In some embodiments, if the output signal 252 of the error detector unit 250 indicates a larger magnitude of difference, this may indicate a larger error or discrepancy between an actual level of the output parameter 202 and a desired level 203 of the output parameter 202. Accordingly, the DMC block 222 may adjust or tune the signal corresponding to the rate of change of the DV 210 more aggressively to more quickly ameliorate the error or discrepancy, e.g., the signal corresponding to the rate of change of the DV 210 may be subject to a larger magnitude of adjustment. Similarly, if the output signal 252 of the error detector unit 250 indicates a smaller magnitude of difference or error, the DMC block 222 may adjust or tune the signal corresponding to the rate of change of the DV 210 less aggressively, e.g., the signal corresponding to the rate of change of the DV 210 may be subject to a smaller magnitude of adjustment. If the output signal 252 indicates that the magnitude of the difference between the actual level of the output parameter 202 and the desired level 203 of the output parameter 202 is essentially zero or otherwise within tolerance (as defined by an operator or by system parameters), then the control system or scheme 200 may be operating in a manner such as to keep the output parameter 202 within an acceptable range, and the signal corresponding to the rate of change of the DV 210 may not be adjusted.

In this manner, the dynamic matrix control block 222 may provide dynamic tuning of the control system or scheme 200. For example, the DMC block 222 may provide dynamic tuning of the rate of change of the DV 210 based on a magnitude of a difference or an error between a desired level 203 and an actual level of the output parameter 202. As the difference or error changes in magnitude, the magnitude of an adjustment of the rate of change of the DV 210 may be changed accordingly.

It should be noted that while FIG. 4 illustrates the error detector block or unit 250 as a separate entity from the DMC block 222, in some embodiments, at least some portions of the error detector block or unit 250 and the DMC block 222 may be combined into a single entity.

Figure 5B:
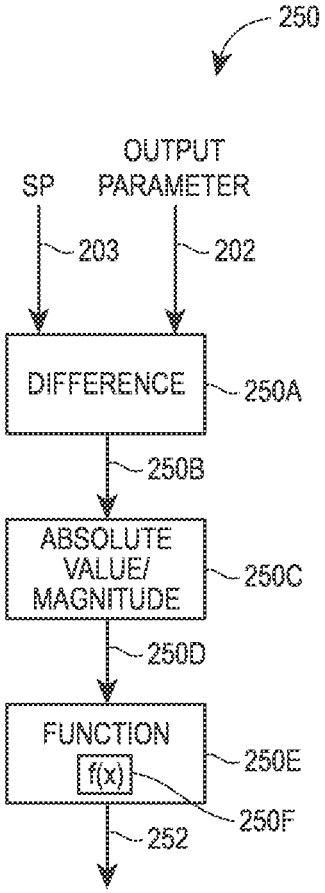
FIG. 5B illustrates an embodiment of the error detector unit of FIG. 4.

FIG. 5B illustrates an embodiment of the error detector unit or block 250 of FIG. 4. In this embodiment, the error detector unit 250 may include a difference block or unit 250A that determines the difference between the actual level of the output parameter 202 and its corresponding setpoint 203. For example, with respect to FIG. 4, the difference block 250A may determine the difference between the actual output steam temperature 202 and a desired output steam temperature setpoint 203. In an embodiment, the difference block or unit 250A may receive a signal indicative of an actual level of the output parameter 202 at a first input, and may receive a signal indicative of a setpoint 203 corresponding to the output parameter 202 at a second input. The difference block or unit 250A may generate an output signal 250B indicative of the difference between the two inputs 202 and 203.

The error detector unit 250 may include an absolute value or magnitude block 250C that receives the output signal 250B of the difference block 250A and determines an absolute value or magnitude of the difference between the received input signals 202 and 203. In the embodiment illustrated in FIG. 5B, the absolute value block 250C may generate an output signal 250D indicative of a magnitude of the difference between the actual 202 and desired 203 values of the output parameter. In some embodiments, the difference block 250A and the absolute value block 250C may be included in a single block (not shown) that receives the input signals 202, 203 and that generates the output signal 250D indicative of the magnitude of the difference between the actual 202 and desired 203 values of the output parameter.

The output signal 250D may be provided to a function block or unit 250E. The function block or unit 250E may include a routine, algorithm or computer-executable instructions for a function f(x) (reference 250F) that operates on the signal 250D (which is indicative of the magnitude of the difference between the actual 202 and desired 203 output parameter levels). The output signal 252 of the error detector block 250 may be based on the output of the function f(x) (reference 250F), and may be provided to the dynamic matrix control block 222. Thus, the signal 250D indicative of the magnitude of the difference between the actual 202 and desired 203 values of the output parameter may be modified based on f(x) (reference 250F), and the modified or adjusted signal 252 may be provided to the dynamic matrix control block 222 to dynamically tune the control system or scheme 200.

In some embodiments, the output signal 252 from the error detector 250 may be stored in a register R that is accessed by the DMC block 222 to generate the control signal 225. In particular, the DMC block 222 may compare the value in the register R to a value in a register Q to determine an aggressiveness of tuning reflected in the control signal 225 to control the control system 200. The value in the register of Q may be, for example, provided by another entity within the control scheme 200 or boiler system 100, may be manually provided, or may be configured. In one example, as the value of R moves away from the value of Q, the DMC may tune the control signal 225 more aggressively to control the process. As the value of R moves towards the value of Q, the DMC block 222 may adjust the control signal 225 accordingly for less aggressive control. In other embodiments, the converse may occur: as the value of R moves towards the value of Q, the DMC may generate a more aggressive signal 225, and as the value of R moves away from the value of Q, the DMC may generated a less aggressive signal 225. In some embodiments, the registers R and Q may be internal registers of the DMC block 222.

Figure 5C:
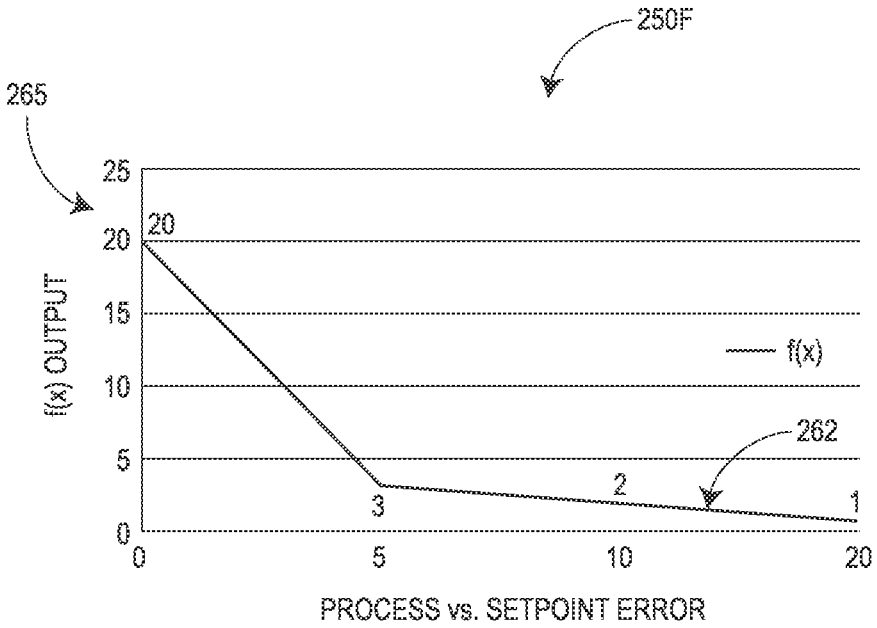
FIG. 5C illustrates an example of a function f(x) included in the function block of FIG. 5B.

FIG. 5C shows an example of a function f(x) (reference 250F) included in the function block 250E of FIG. 5B. The function f(x) (reference 250F) may use the difference between the current or actual value of the output parameter 202 and its corresponding setpoint 203 as an input, as shown by the x-axis 260. In some embodiments, the value of the input 260 of f(x) may be indicated by the signal 250D in FIG. 5B. The function f(x) may include a curve 262 that indicates an output value (e.g., the y-axis 265) for each input value 260. In some embodiments, a value of the output 265 of f(x) (reference 250F) may be stored in the R register of the DMC block 222 and may influence the control signal 225. In the example shown in FIG. 5C, an error or difference of temperature between a current process value and its setpoint having a magnitude of 10 may result in an f(x) output of 2, and a zero error may result in an f(x) output of 20.

Of course, while FIG. 5C illustrates one embodiment of the function f(x), other embodiments of f(x) may be used in conjunction with the error detection block 250. For example, the curve 262 may be different than that shown in FIG. 5C. In another example, the ranges of the values of the x-axis 260 and/or the y-axis 265 may differ from FIG. 5C. In some embodiments, the output or y-axis of the function f(x) may not be provided to a register R. In some embodiments, the output of the function f(x) may be the equivalent of the output 252 of the error detector 250. Other embodiments of f(x) may be possible.

In some embodiments, at least some portion of the function f(x) (reference 250F) may be modifiable. That is, an operator may manually modify one or more portions of the function f(x), and/or one or more portions of the function f(x) may be automatically modified based on one or more parameters of the control scheme 200 or of the boiler 100. For example, one or more boundary conditions of f(x) may be changed or modified, a constant included in f(x) may be modified, a slope or curve of f(x) between a certain range of input values may be modified, etc.

Turning back to FIG. 5B, in some embodiments of the error detector block 250, the function block 250E may be omitted. In these embodiments, the signal indicative of the magnitude of the difference between the actual 202 and desired 203 values of the output parameter (reference 250D) may be equivalent to the output signal 252 generated by the error detector block 250.

Figure 5D:
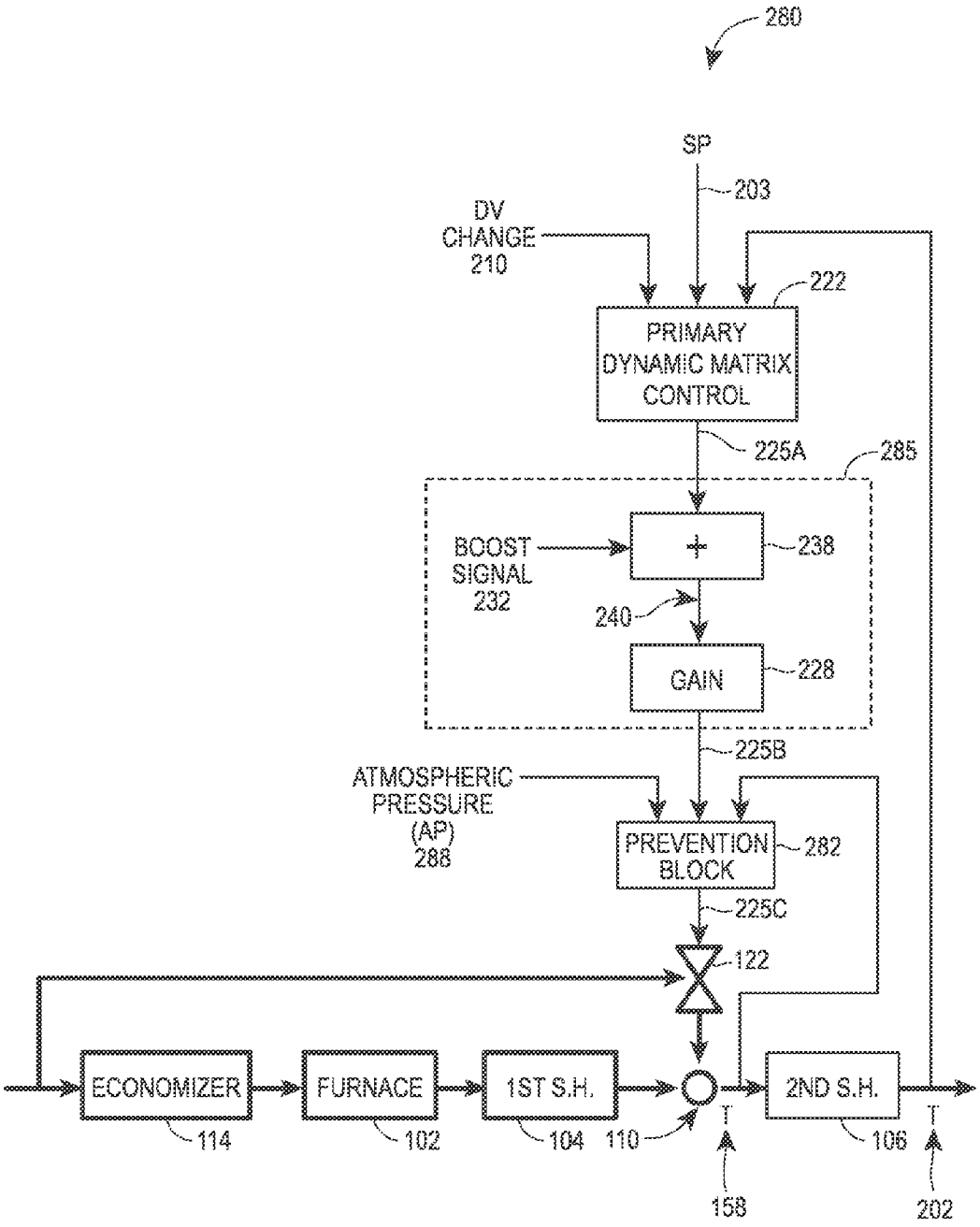
FIG. 5D illustrates a schematic diagram of a manner of controlling the boiler steam cycle of the steam powered turbines of FIG. 1 in a manner which includes prevention of saturated steam from entering a superheater section of a steam generation boiler system.

Some embodiments of the dynamic matrix control scheme or control system 200 may include prevention of saturated steam from entering the superheater 106. As commonly known, if steam at saturation temperature is delivered to the final superheater 106, the saturated steam may enter the turbine 202 and consequently may cause potentially undesirable results, such as damage to the turbine. Accordingly, FIG. 5D illustrates an embodiment of the dynamic matrix control scheme or system 200 that includes a prevention block 282 to aid in prevention of saturated steam from entering the superheater 106. For brevity and clarity, FIG. 5D does not replicate the entire control scheme or system 200 illustrated in FIG. 4. Rather, a section 280 of the control scheme 200 of FIG. 4 that includes the prevention block 282 is shown in FIG. 5D. It should be noted that while FIG. 5D illustrates the prevention block 282 as a separate entity from the DMC block 222, in some embodiments, at least some portions of the prevention block 282 and the DMC block 222 may be combined into a single entity.

The prevention block 282 may receive, at a first input, a control signal 225B from the primary DMC block 222. The DMC block 222 may include a routine that generates a control signal 225A that is similar to the routine of the DMC block 222 that generates the control signal 225 in FIG. 4. The embodiment 280 of FIG. 5D is further similar to FIG. 4 in that the control signal 225A is shown as summed with the boost signal 232 at the block 238, and the summed signal is modified by gain in the block 228 to produce control signal 225B. As also previously discussed, in some embodiments the block 238 and/or the block 228 may be optional (as denoted by the dashed lines 285), and one or both of the blocks 238 and 228 may be omitted. For example, in embodiments where the blocks included in the dashed lines 285 are omitted, the control signal 225B is equivalent to the control signal 225A.

The prevention block 282 may receive, at a second input, a signal indicative of atmospheric pressure (AP) 288, and may receive, at a third input, a signal indicative of the current intermediate steam temperature 158. Based on the atmospheric pressure, the prevention block 282 may determine a saturated steam temperature. Based on the saturated steam temperature and the current intermediate steam temperature 158, the prevention block 282 may determine a magnitude of a temperature difference between the temperatures 158 and 288, and may determine an adjustment or modification to the control signal 225B corresponding to the magnitude of the temperature difference to aid in preventing the intermediate steam temperature 158 from reaching the saturated steam temperature. Upon applying the adjustment or modification to the control signal 225B, the prevention block 282 may provide, at an output, an adjusted or modified control signal 225C to control the intermediate steam temperature 158. In the example illustrated in FIG. 5D, the adjusted or modified control signal 22*dsz* may be provided to the spray valve 122, and the spray valve 122 may adjust its opening or closing based on the modified control signal 225C to aid in preventing the intermediate steam temperature 158 from reaching the saturated steam temperature.

Figure 5E:
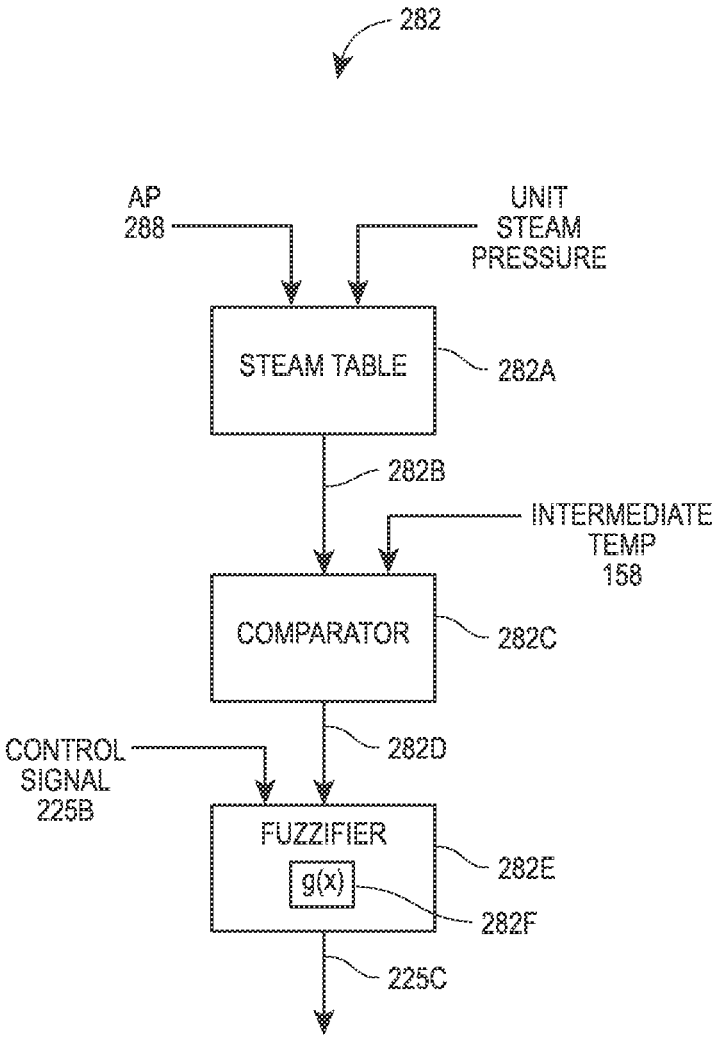
FIG. 5E illustrates an embodiment of the prevention block of FIG. 5D.

FIG. 5E illustrates an embodiment of the prevention unit or block 282 of FIG. 5D. The prevention unit or block 282 may receive the signal indicative of a current atmospheric pressure (AP) 288 at a first input of a steam table or steam calculator 282A, and may receive a unit steam pressure at a second input of the steam table 282A. Steam tables or steam calculators, such as the steam table 282A, may determine a saturated steam temperature 282B based on a given atmospheric pressure and the unit steam pressure. A signal indicative of the saturated steam temperature 282B may be provided from the steam table 282A to a first input of a comparator block or unit 282C. The comparator block 282C may receive a signal indicative of the current intermediate steam temperature 158 at a second input, and based on the two received signals, may determine a temperature difference between the saturated steam temperature 282B and the current intermediate steam temperature 158. In an exemplary embodiment, the comparator block or unit 282C may determine a magnitude of the temperature difference. In other embodiments, the comparator block or unit 282C may determine a direction of the temperature difference, e.g., whether the temperature difference is increasing or decreasing. The comparator 282C may provide a signal 282D indicative of the magnitude of the temperature difference or the direction of temperature difference to a fuzzifier block or unit 282E.

The fuzzifier block 282E may receive the signal 282D at a first input, and may receive the control signal 225B at a second input. Based on the signal 282D from the comparator 282C (e.g., based on a temperature difference between the saturated steam temperature 282B and the current value of the intermediate steam temperature 158), the fuzzifier block 282E may determine an adjustment or modification to the control signal 225B, and may generate the adjusted or modified signal 225C at an output.

In some embodiments, the adjustment or modification to the control signal 225B may be determined based on a comparison of the magnitude of the temperature difference to a threshold T, so that the fuzzifier 282E does not adjust or modify the signal 225B until the threshold T is crossed. In an example, the threshold T may be 15 degrees Fahrenheit (F), and the examples and embodiments discussed herein may refer to the threshold T as being 15 degrees F. for clarity of discussion. It is understood, however, that other values or units of the threshold T may be possible. Furthermore, in some embodiments, the threshold T may be adjustable, either automatically or manually.

In embodiments including a threshold T, when the magnitude of the difference between the saturated steam temperature 282B and the actual intermediate steam temperature is less than T (e.g., less than 15 degrees F.), the fuzzifier block 282E may apply an adjustment to the control signal 225B to generate a modified control signal 225C. The applied adjustment may be based on the signal 282D, for instance. The modified control signal 225C may be provided to the spray valve 122 to control the spray valve 122 to move towards a closed position. The movement of the spray valve 122 towards a closed position may result in an increase of the intermediate steam temperature 158, and thus may decrease the possibility of steam at a saturation temperature from entering the superheater 106. When the magnitude of the difference between the saturated steam temperature 282B and the actual intermediate steam temperature 158 is greater than T, the intermediate steam temperature 158 may be at an acceptable distance from the saturated steam temperature 282B, and the fuzzifier 282E may simply pass the control signal 225B to the field device 122 without any adjustment (e.g., the adjusted control signal 225C is equivalent to the control signal 225B).

Of course, 15 degrees F. is only one example of a possible threshold value. The threshold may be set to other values. Indeed, the threshold value may be modifiable, either manually by an operator, automatically based on one or more values or parameters in the steam boiler generating system, or both manually and automatically.

In some embodiments, the determination of the adjustment to the control signal 225B by the fuzzifier block 282E may be based on an algorithm, routine or computer-executable instructions for a function g(x) (reference 282F) included in the fuzzifier block 282E. The function g(x) may or may not include the threshold T. For example, the adjustment routine g(x) (reference 282F) may generate an adjusted control signal 225C to control the rate of closing and opening of the spray valve 122 based on the direction (e.g., increasing or decreasing) of the temperature difference irrespective of the threshold T. In another example, the adjustment routine g(x) that may not adjust the control signal 225B when the magnitude of the temperature difference is greater than the threshold T, but may determine an adjustment to the control signal 225B corresponding to a rate of increase or decrease of the magnitude of the temperature difference when the temperature difference is less than the threshold T. Other examples of embodiments of g(x) (reference 282F) may be possible and used in the fuzzifier 282E.

In some embodiments, at least some portion of the algorithm or function g(x) (reference 282F) may itself be modified or adjusted, either manually or automatically, in a manner similar to possible modifications or adjustments to f(x) of FIG. 5C.

Figure 5F:
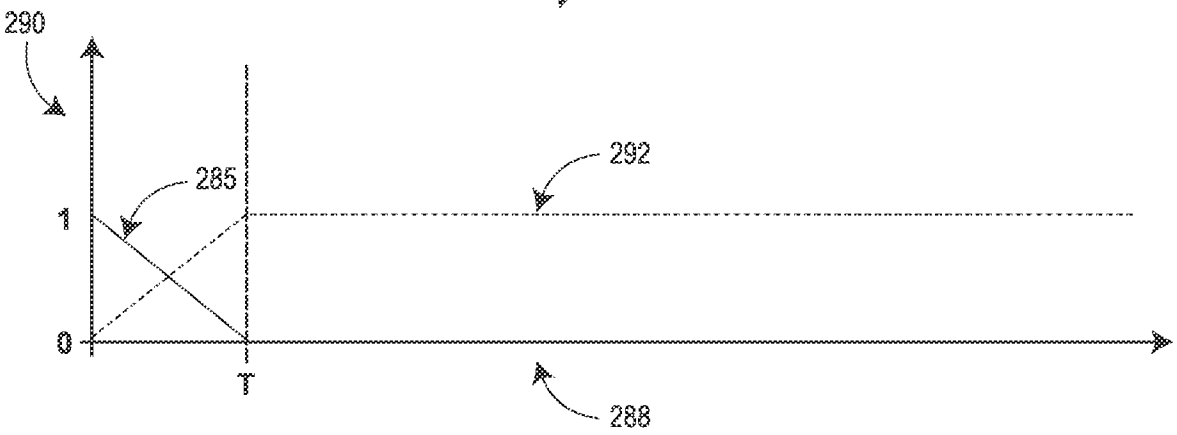
FIG. 5F illustrates an example of a function g(x) included in the fuzzifier of FIG. 5E.

FIG. 5F shows an exemplary embodiment of a function g(x) (reference 282F). In this embodiment, at least a portion of g(x) (reference 282F) may be represented by a curve 285. The x-axis 288 may include a range of values corresponding to a range of magnitudes of temperature differences between the saturated steam temperature 282C and a current intermediate steam temperature 158. For example, the range of values of the x-axis 288 may correspond to the range of values indicated by the signal 282D received at the fuzzifier 282E of FIG. 5E. The y-axis 290 may include a range of values of a multiplier that is to be applied to the magnitude of the temperature difference between the saturated steam temperature and the current intermediate steam temperature, e.g., to be applied to the signal 282D. In FIG. 5F, the units of the y-axis 290 are shown as fractional, e.g., the multiplier may range from a value of zero through a plurality of fractional values up to a maximum value of one. In other embodiments, the multiplier may be expressed in other units such as a percentage, e.g., 0% through 100%.

Using the curve 285, for a given magnitude of temperature difference 288, a corresponding multiplier value 290 may be determined, and the determined multiplier value 290 may be applied to the input signal 282D received by the fuzzifier 282E. The modified input signal then may be used by the fuzzifier 282E to adjust or modify the control signal 225B to generate an adjusted or modified control signal 225C, and the adjusted control signal 225C may be output by the fuzzifier 282E.

In the embodiment of the curve 285 illustrated in FIG. 5F, when the temperature difference is greater than a threshold T (e.g., x>T), the intermediate steam temperature 158 may be sufficiently above the saturated steam temperature 282B, thus indicating that the current level of control is sufficient to maintain the intermediate steam temperature 158 in a desired range. Accordingly, the control signal 225B may not need any adjustment, and as such, the curve 285 may indicate that a corresponding multiplier to be applied to the input signal 282D is essentially zero or negligible. In this scenario, the signal 282D may minimally or not affect (the control signal 225B, and the output control signal 225C of the fuzzifier 282E may be essentially equivalent to the input control signal 225B.

When the magnitude of the temperature difference is less than the threshold T (e.g., x<T), the intermediate steam temperature 285 may be moving undesirably close to the steam saturation temperature. In these scenarios, the control signal 225B may require more aggressive adjustment. As such, as the temperature difference nears zero, the multiplier 290 may increase according to the curve 285. For example, when the intermediate steam temperature is essentially identical to the saturated steam temperature (e.g., x=0), a multiplier of one may be applied to the signal 282D so that in the signal 282D may fully affect the control signal 225B to generate the output control signal 225C. In another example, for a temperature difference of 7.5 degrees (e.g., x=7.5), the curve 285 may indicate that the multiplier to be applied to the input signal 282D is 0.5 or 50%, and thus the modified signal 282D may have half the effect on the control signal 225B as compared to when the temperature difference is essentially zero. In this manner, as more aggressive control is required by the control scheme 200, the function g(x) may more aggressively apply a multiplier of the signal 282D to adjust the input control signal 225B.

FIG. 5F includes an additional curve 292 superimposed on the curve 285 to illustrate the effect of g(x) (reference 282F) on the positioning of a field device. The curve 292 may demonstrate movement of the field device in response to the output control signal 225C generated by the fuzzifier 282E. In this embodiment, the field device may be a spray valve that affects the intermediate steam temperature such as the valve 122, although the principles described herein may be applied to other field devices.

The curve 292 may define a position multiplier 290 for a current device position for each value of magnitudes of temperature differences between the saturated steam temperature and the current intermediate steam temperature 288. In this embodiment of the curve 292, when the difference between saturation and intermediate steam temperatures is at or above the threshold T (e.g., x>T), the system 200 may be operating at or above a desired range of temperature difference and thus may not need the spray valve 122 to increase or decrease its current spray volume in order to maintain the current operating conditions. Accordingly, the curve 292 indicates that for temperature differences above the threshold T, the valve position may not change from its current value (e.g., the device position multiplier is one).

However, when the intermediate steam temperature begins to move towards the saturation steam temperature (e.g., x<T), the intermediate steam temperature 158 may be desired to increase. To affect the desired increase in the intermediate steam temperature 158, the volume of cooling spray currently being provided by the valve 122 may be desired to decrease. Accordingly, as x moves towards zero, the curve 292 may indicate that the position multiplier 290 decreases to move the valve towards a closed position. For example, the curve 292 indicates that when the temperature difference is 7.5 degrees, the position multiplier 290 to be applied to the current valve position may be 0.5 or 50%, so the valve may be controlled by the output control signal 225C of the fuzzifier 282E to move towards half of its current position. When the intermediate steam temperature is essentially at the saturated steam temperature (e.g., x=0), the position multiplier 290 to be applied to the current valve position is essentially zero, so that the valve may be controlled by the output control signal 225C to move to zero percent of its current position (e.g., fully closed), thus controlling the intermediate steam temperature to rise as quickly as possible.

As described above, the superimposition of the curve 292 on the curve 285 corresponding to g(x) (reference 282F) illustrates one of many possible examples of how the input signal 282D to the fuzzifier 282E may be modified based on the intermediate steam temperature value 158, and how the resulting adjusted or modified control signal 225C output by the fuzzifier 282E may affect the positioning of a field device 122. Of course, the curves 285 and 292 are exemplary only. Other embodiments of curves 285 and 292 are possible and may be used in conjunction with the present disclosure.

Figure 6:
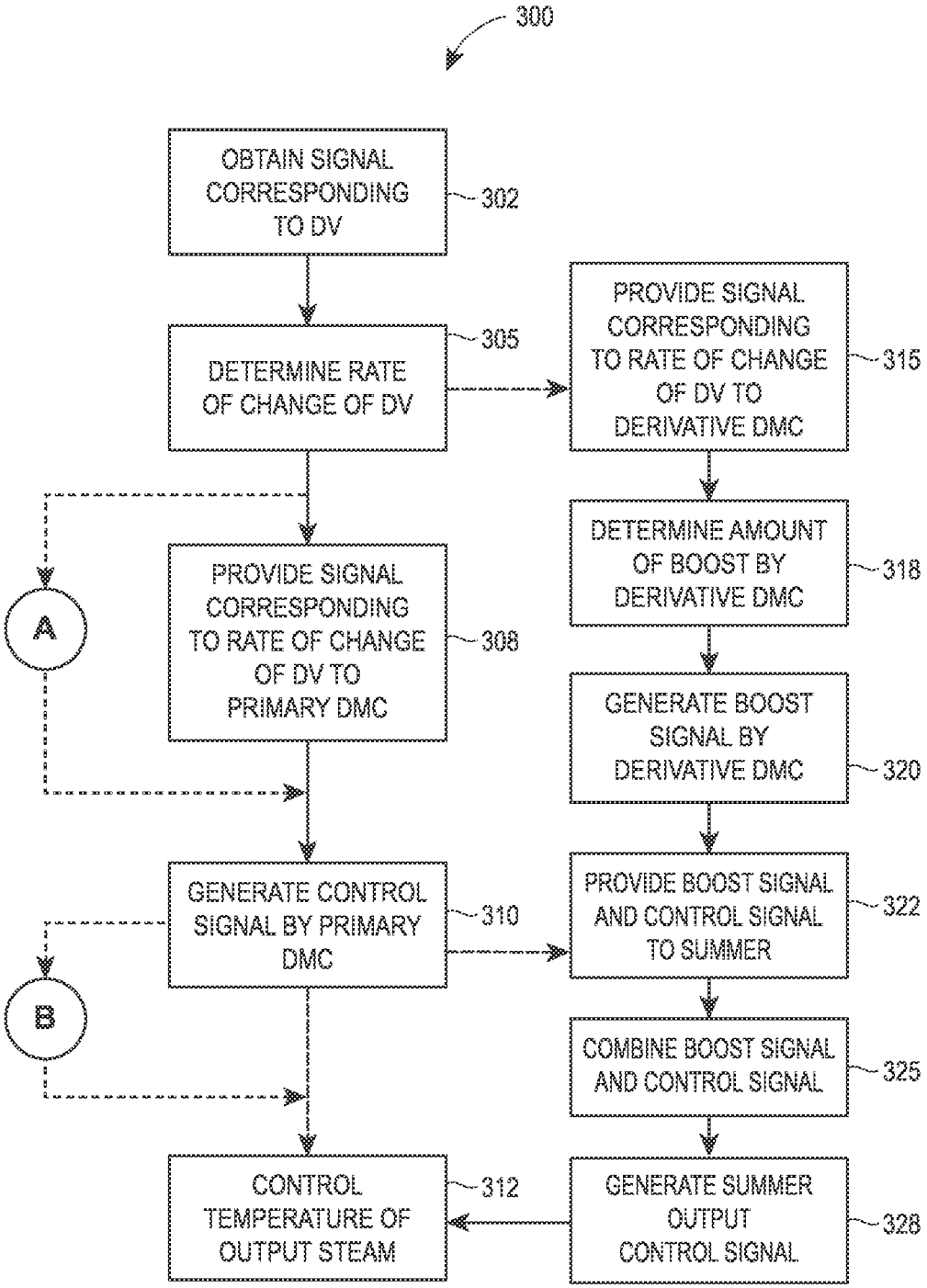
FIG. 6 illustrates an exemplary method of controlling a steam generating boiler system.

FIG. 6 illustrates an exemplary method 300 of controlling a steam generating boiler system, such as the steam generating boiler system 100 of FIG. 1. The method 300 may also operate in conjunction with embodiments of the control system or control scheme 200 of FIG. 4. For example, the method 300 may be performed by the control system 200 or the controller 120. For clarity, the method 300 is described below with simultaneous referral to the boiler 100 of FIG. 1 and to the control system or scheme 200 of FIG. 4.

At block 302, a signal 208 indicative of a disturbance variable used in the steam generating boiler system 100 may be obtained or received. The disturbance variable may be any control, manipulated or disturbance variable used in the boiler system 100, such as a furnace burner tilt position; a steam flow; an amount of soot blowing; a damper position; a power setting; a fuel to air mixture ratio of the furnace; a firing rate of the furnace; a spray flow; a water wall steam temperature; a load signal corresponding to one of a target load or an actual load of the turbine; a flow temperature; a fuel to feed water ratio; the temperature of the output steam; a quantity of fuel; or a type of fuel. In some embodiments, one or more signals 208 may correspond to one or more disturbance variables. At block 305, a rate of change of the disturbance variable may be determined. At block 308, a signal 210 indicative of the rate of change of the disturbance variable may be generated and provided to an input of a dynamic matrix controller, such as the primary DMC block 222. In some embodiments, the blocks 302, 305 and 308 may be performed by the change rate deter miner 205.

At block 310, a control signal 225 corresponding to an optimal response may be generated based on the signal 210 indicative of the rate of change of the disturbance variable generated at the block 308. For example, the control signal 225 may be generated by the primary DMC block 222 based on the signal 210 indicative of the rate of change of the disturbance variable and a parametric model corresponding to the primary DMC block 222. At block 312, a temperature 202 of output steam generated by the steam generating boiler system 100 immediately prior to delivery to a turbine 116 or 118 may be controlled based on the control signal 225 generated by the block 310.

In some embodiments, the method 300 may include additional blocks 315-328. In these embodiments, at the block 315, the signal 210 corresponding to the rate of change of the disturbance variable determined by the block 305 may also be provided to a derivative dynamic matrix controller, such as the derivative DMC block 230 of FIG. 4. At the block 318, an amount of boost may be determined based on the rate of change of the disturbance variable, and at the block 320, a boost signal or a derivative signal 232 corresponding to the amount of boost determined at the block 318 may be generated.

At the block 322, the boost or derivative signal 232 generated at the block 320 and the control signal 225 generated at the block 310 may be provided to a summer, such as the summer block 238 of FIG. 4. At the block 325, the boost or derivative signal 232 and the control signal 225 may be combined. For example, the boost signal 232 and the control signal 225 may be summed, or they may be combined in some other manner. At the block 328, a summer output control signal may be generated based on the combination, and at the block 312, the temperature of the output steam may be controlled based on the summer output control signal. In some embodiments, the block 312 may include providing the control signal 225 to a field device in the boiler system 100 and controlling the field device based on the control signal 225 so that the temperature 202 of the output steam is, in turn, controlled. Note that for embodiments of the method 300 that include the blocks 315-328, the flow from the block 310 to the block 312 is omitted and the method 300 may flow instead from the block 310 to the block 322, as indicated by the dashed arrows.

Figure 7:
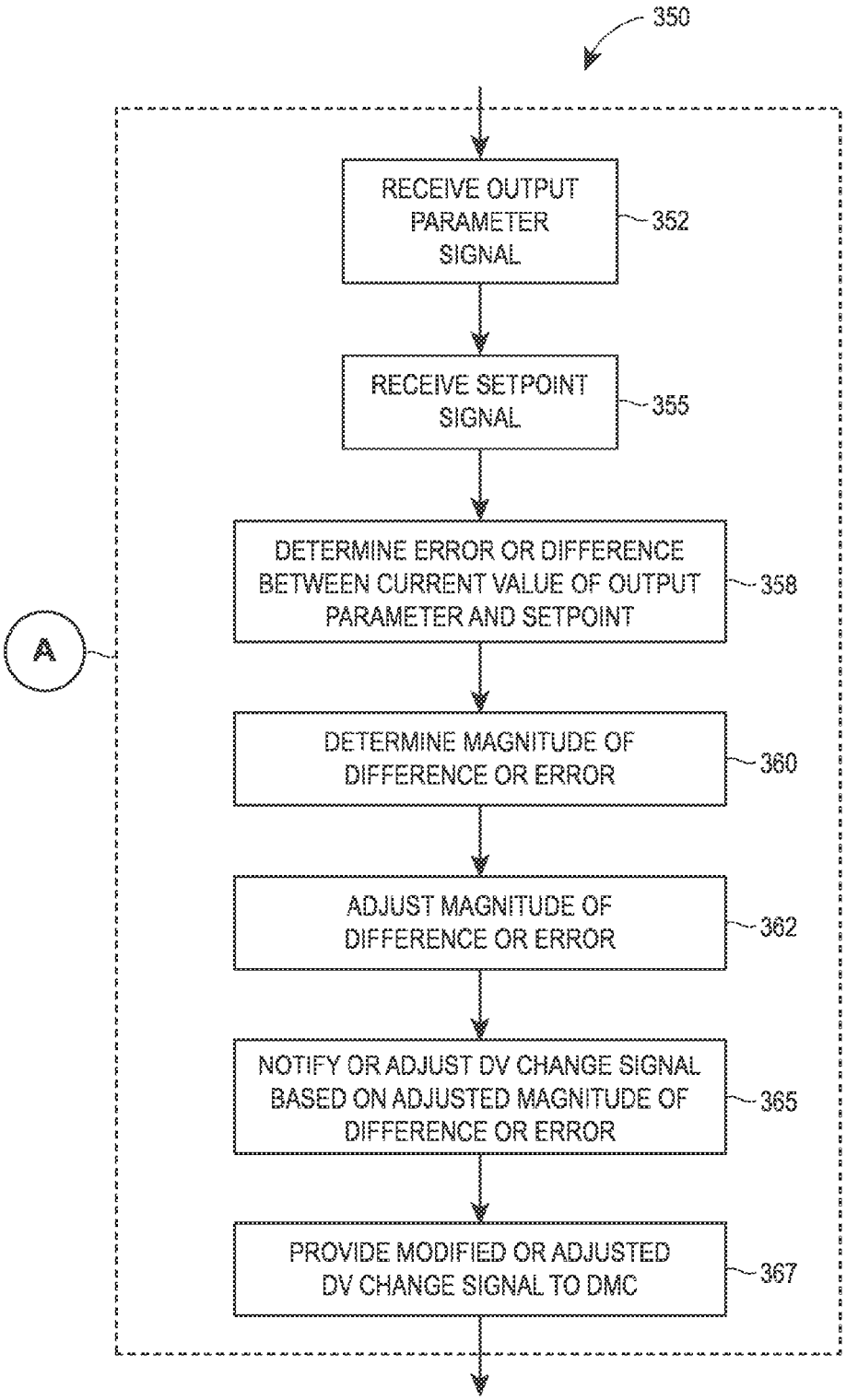
FIG. 7 illustrates an exemplary method of dynamically tuning control of a steam generating boiler system.

FIG. 7 illustrates a method 350 of dynamically tuning the control of a steam generating boiler system, such as the boiler system of FIG. 1. The method 350 may operate in conjunction with embodiments of the control system or control scheme 200 of FIG. 4, with embodiments of the error detector unit or block 250 of FIG. 5B, with embodiments of the function f(x) of FIG. 5C, and/or with embodiments of the method 300 of FIG. 6. For clarity, the method 350 is described below with simultaneous referral to the boiler system 100 of FIG. 1, the control system or scheme 200 of FIG. 4, and the error detector unit or block 250 of FIG. 5B.

At a block 352, a signal indicative of an output parameter of a steam generating boiler system (such as the system 100) or of a level of the output parameter of the steam generating boiler system may be obtained or received. The output parameter may correspond to, for example, an amount of ammonia generated by the boiler system, a level of a drum in the steam boiler system, a pressure of a furnace in the boiler system, a pressure at a throttle of the boiler system, or some other quantified or measured output parameter of the boiler system. In one example, the output parameter may correspond to a temperature of output steam generated by the boiler system 100 and provided to a turbine, such as the temperature 202 of FIG. 4. In some embodiments, the signal indicative of the output parameter of the steam generating boiler system may be obtained or received by an error detector block or unit, such as the error detector block or unit 250 of FIG. 4. In some embodiments, the signal indicative of the output parameter of the steam generating boiler system 100 may be obtained or received directly by a dynamic matrix control block such as the DMC block 222 of FIG. 4.

At a block 355, a signal indicative of a setpoint corresponding to the output parameter may be obtained or received. For example, the setpoint may be a setpoint corresponding to the temperature of output steam generated by the boiler system and provided to a turbine, such as the setpoint 203 of FIG. 4. In some embodiments, the signal indicative of the setpoint may be obtained or received by an error detector block or unit, such as the error detector block or unit 250 of FIG. 4. In some embodiments, the signal indicative of the setpoint may be obtained or received directly by a dynamic matrix control block, such as the DMC block 222 of FIG. 4.

At a block 358, a difference or an error between the actual value of the output parameter (e.g., the reference 202) obtained at the block 352 and the desired value of the output parameter (e.g., the reference 203) obtained at the block 355 may be determined. For example, the difference between the actual 202 and desired 203 values of the output parameter may be determined by a difference block or unit 250A in the error detector block or unit 250. In another example, the DMC block 222 may determine the difference between the actual 202 and desired 203 values of the output parameter.

At a block 360, a magnitude or size of the difference/error determined at the block 358 may be determined. For example, the magnitude of the difference may be determined at the block 360 by taking the absolute value of the difference determined at the block 358. In some embodiments, at the block 360, the absolute value block 250C of FIG. 5B may determine the magnitude of the difference between the actual 202 and desired 203 values of the output parameter.

At an optional block 362, the magnitude of the difference between the actual 202 and desired 203 values of the output parameter may be modified or adjusted. For example, a signal indicative of the magnitude of the difference between the actual 202 and desired 203 values of the output parameter (e.g., the output generated by the block 360) may be modified or adjusted by a function f(x) such as illustrated by reference 250F in FIG. 5C. The function f(x) may receive the signal indicative of the magnitude of the difference between the actual 202 and desired 203 values of the output parameter as an input. After the function f(x) operates on the signal indicative of the magnitude of the difference, the function f(x) may produce an output corresponding to a signal indicative of the modified or adjusted magnitude of the difference between the actual 202 and desired 203 values of the output parameter.

In some embodiments, the block 362 may be performed by the error detector block 250, such as by the function block 250E of the error detector block 250. In some embodiments, the block 362 may be performed by the dynamic matrix control block 222. In some embodiments, the block 362 may be omitted altogether, such as when f(x) is not desired or required. In these embodiments, the block 365 may directly follow the block 360 in the method 350.

At the block 365, the signal indicative of the modified or adjusted magnitude of difference or error between the actual 202 and desired 203 values of the output parameter may be used to modify or adjust the signal corresponding to the rate of change of a disturbance variable, such as signal 210 of FIG. 4. In a preferred embodiment, f(x) used in the block 362 may be defined so that as the magnitude of the difference or error between the actual 202 and desired 203 values of the output parameter increases, the rate or magnitude of adjustment or modification of the signal corresponding to the rate of change of the DV is increased at the block 365, and as the magnitude of the difference or error between the actual 202 and desired 203 values of the output parameter decrease, the rate or magnitude of adjustment or modification of the signal corresponding to the rate of change of the DV is decreased at the block 365. For negligible differences/errors, or for differences/errors within the tolerance of the steam generating boiler system 100, the signal corresponding to the rate of change of the DV may not be adjusted or modified at all. In this manner, as the magnitude of error or discrepancy between the actual 202 and desired 203 values of the output parameter changes in size, the signal corresponding to the rate of change of the DV may changed accordingly at the block 365 as defined by f(x).

At a block 367, the modified or adjusted signal generated at the block 365 may be provided to the DMC block 222. If the signal corresponding to the rate of change of the DV 210 is not modified or adjusted at the block 365, then a control signal equivalent to the original signal 210 (including any desired gain 220) may be provided to the DMC block 222.

In some embodiments, the block 365 may be performed by the DMC block 222. In these embodiments, the signal corresponding to the output of f(x) may be received by the DMC block 322 at a first input (e.g., reference 252 of FIG. 4) and may be stored in a first register or storage location R. The signal corresponding to the rate of change of a disturbance variable may be received at a second input (e.g., reference 210 or 220 of FIG. 4). The DMC block 222 may compare the values stored in Q and R, and may determine a magnitude or absolute value of the difference. Based on the magnitude or absolute value of the difference between Q and R, the DMC block 222 may determine an amount of adjustment or modification to the rate of change of the DV, and may generate a modified or adjusted signal corresponding to the DV. The DMC block 222 may then generate a control signal 225 based on the modified or adjusted signal corresponding to the DV.

In some embodiments, instead of the block 365 being performed by the dynamic matrix control block 222, the block 365 may be performed by another block (not pictured) in connection with the DMC block 222. In these embodiments, the rate of change of a disturbance variable (e.g., reference 210 or 220 of FIG. 4) may be modified or adjusted based on the magnitude of the difference between the actual 202 and the desired 203 values of the output parameter. The modified or adjusted signal corresponding to the DV may then be provided as an input to the DMC block 222 to use in conjunction with other inputs to generate the control signal 225.

In some embodiments, the method 350 of FIG. 7 may operate in conjunction with the method 300 of FIG. 6. For example, the modified or adjusted signal corresponding to the rate of change of the DV (e.g., as generated by the block 365 of FIG. 7) may be provided to the DMC block 222 as an input 252 to use in generating the control signal 225. In this example, the method 350 of FIG. 7 may be substituted for the block 308 of FIG. 6, such as illustrated by the connector A shown in FIGS. 6 and 7.

Figure 8:
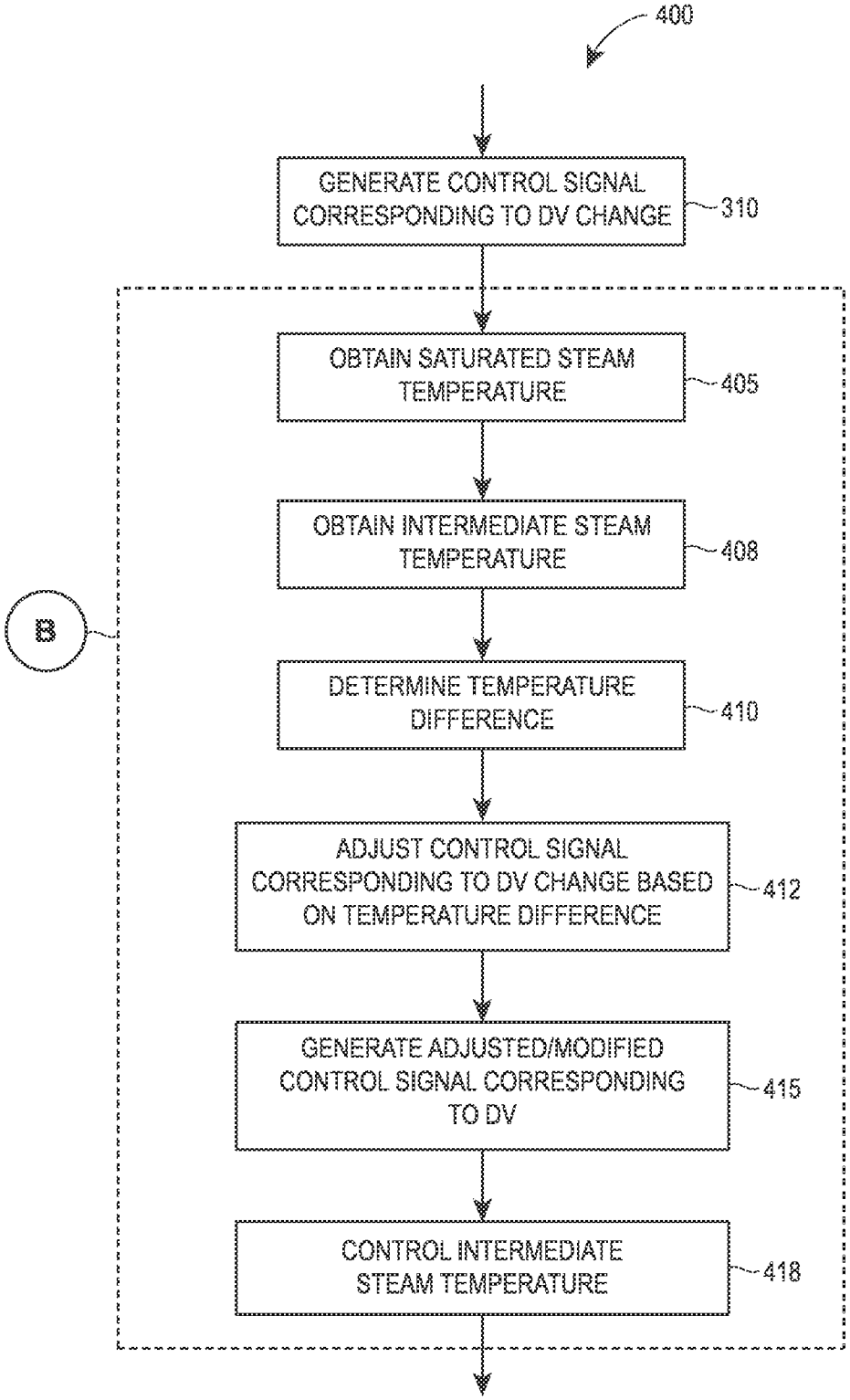
FIG. 8 illustrates an exemplary method of preventing saturated steam from entering a superheater section of a steam generation boiler system.

FIG. 8 illustrates a method 400 of preventing saturated steam from entering a superheater section of a steam generating boiler system, such as the boiler system of FIG. 1. The method 400 may operate in conjunction with embodiments of the control system or control scheme 200 of FIGS. 4 and 5D, with embodiments of the prevention unit or block 282 of FIG. 5E, with embodiments of g(x) discussed with respect to FIG. 5F, and/or with embodiments of the method 300 of FIG. 6 and/or the method 350 of FIG. 7. For clarity, the method 400 is described below with simultaneous referral to the boiler system 100 of FIG. 1, the control system or scheme 200 of FIGS. 4 and 5D, and the prevention unit or block 282 of FIGS. 5B and 5E.

At a block 310, a control signal may be generated based on a signal indicative of a rate of change of a disturbance variable used in the steam generating boiler system. The control signal may be generated by a dynamic matrix controller. For example, as shown in FIG. 4, the dynamic matrix controller block 222 may generate a control signal 225 based on the signal 210 indicative of the rate of change of disturbance variable 208. Note that the block 310 also may be included in the method 300 of FIG. 6.

At a block 405, a saturated steam temperature may be obtained. The saturated steam temperature may be obtained, in an example, by obtaining a current atmospheric pressure and determining the saturated steam temperature based on the atmospheric pressure from a steam table or calculator. For example, as shown in FIG. 5E, a steam table 282A may receive a signal indicative of a current atmospheric pressure 288, may determine a corresponding saturated steam temperature 282B, and may generate a signal indicative of the corresponding saturated steam temperature 282B.

At a block 408, a temperature of intermediate steam may be obtained. The temperature of intermediate steam may be obtained, for example, at a location in the boiler 100 where intermediate steam is being provided to a superheater or a final superheater. In one example, a signal indicative of a current intermediate steam temperature 158 in FIG. 5D may be obtained by a comparator block or unit 282C.

At a block 410, the saturated steam temperature and the current intermediate steam temperature may be compared to determine a temperature difference. In some embodiments, a magnitude of temperature difference may be determined. In some embodiments, a direction (e.g., increasing or decreasing) of temperature difference may be determined. For example, as illustrated in FIG. 5D, a comparator 282C may receive a signal indicative of the corresponding saturated steam temperature 282B and a signal indicative of a current intermediate steam temperature 158, and the comparator 282C may determine the magnitude and/or the direction of temperature difference based on the two received signals.

At a block 412, an adjustment or modification to the control signal generated at the block 310 may be determined based on the temperature difference determined at the block 410. For example, a fuzzifier block or unit such as the fuzzifier 282E of FIG. 5E may determine an adjustment or the modification to the control signal 225B based on the signal indicative of the temperature difference 282D. In some embodiments, the adjustment or modification to the control signal may be based on a comparison of the magnitude of the temperature difference to a threshold. In some embodiments, the adjustment or modification to the control signal may be based on a routine, algorithm or function such as g(x) (reference 282F) that is included in the fuzzifier unit 282E.

At a block 415, an adjusted or modified control signal corresponding to the rate of change of the DV may be generated. For example, the fuzzifier 282E may generate an adjusted or modified control signal 225C based on the adjustment or modification determined at the block 412.

At a block 418, the intermediate steam temperature may be controlled based on the adjusted or modified control signal. In the embodiment of FIG. 4, the field device 122 may receive the adjusted control signal 225C and respond accordingly to control the intermediate steam temperature 158. In embodiments where the field device 122 is a spray valve, the spray valve may move towards an open position or towards a closed position based on the adjusted control signal 225C.

In some embodiments, the method 400 of FIG. 8 may operate in conjunction with the method 300 of FIG. 6. For example, the blocks 405 through 418 of the method 400 may be executed prior to controlling the temperature of the output steam 312 of the method 300, as denoted by the connector B in FIGS. 6 and 8.

Still further, the control schemes, systems and methods described herein are each applicable to steam generating systems that use other types of configurations for superheater and reheater sections than illustrated or described herein. Thus, while FIGS. 1-4 illustrate two superheater sections and one reheater section, the control scheme described herein may be used with boiler systems having more or less superheater sections and reheater sections, and which use any other type of configuration within each of the superheater and reheater sections.

Moreover, the control schemes, systems and methods described herein are not limited to controlling only an output steam temperature of a steam generating boiler system. Other dependent process variables of the steam generating boiler system may additionally or alternatively be controlled by any of the control schemes, systems and methods described herein. For example, the control schemes, systems and methods described herein are each applicable to controlling an amount of ammonia for nitrogen oxide reduction, drum levels, furnace pressure, throttle pressure, and other dependent process variables of the steam generating boiler system.

Although the forgoing text sets forth a detailed description of numerous different embodiments of the invention, it should be understood that the scope of the invention is defined by the words of the claims set forth at the end of this patent. The detailed description is to be construed as exemplary only and does not describe every possible embodiment of the invention because describing every possible embodiment would be impractical, if not impossible. Numerous alternative embodiments could be implemented, using either current technology or technology developed after the filing date of this patent, which would still fall within the scope of the claims defining the invention.

Thus, many modifications and variations may be made in the techniques and structures described and illustrated herein without departing from the spirit and scope of the present invention. Accordingly, it should be understood that the methods and apparatus described herein are illustrative only and are not limiting upon the scope of the invention.

What is claimed is:

1. A method of dynamically tuning control of a steam generating boiler system, comprising:

determining, by an error detector, a presence of an error corresponding to a temperature of output steam, wherein the output steam is generated by the steam generating boiler system for delivery to a turbine, and the determination of the presence of the error is based on a magnitude of a difference between a signal indicative of a measured temperature of the output steam received at the error detector and a signal indicative of a setpoint received at the error detector;

providing, by an output of the error detector to a dynamic matrix controller of a control loop of the steam generating boiler system operating to control the temperature of the output steam, a signal corresponding to the error;

receiving, at the dynamic matrix controller, (i) the signal corresponding to the error provided by the output of the error detector, (ii) a signal indicative of a rate of change of a disturbance variable generated by a device used in a portion of the steam generating boiler system, the portion of the steam generating boiler system excluding any devices included in the control loop, (iii) the signal indicative of the measured temperature of the output steam, and (iv) the signal indicative of the setpoint;

adjusting, by the dynamic matrix controller based on the signal corresponding to the error, the signal indicative of the rate of change of the disturbance variable;

generating, by the dynamic matrix controller, a control signal based on the adjusted signal indicative of the rate of change of the disturbance variable of the portion of the steam generating boiler system; and controlling, based on the control signal, a manipulated variable of the control loop of the steam generating boiler system to thereby control the temperature of the output steam.

2. The method of claim 1, wherein determining the presence of the error corresponding to the temperature of the output steam comprises detecting a difference between the signal indicative of the setpoint and the signal indicative of the measured temperature of the output steam.

3. The method of claim 1, wherein adjusting the signal indicative of the rate of change of the disturbance variable based on the signal corresponding to the error comprises adjusting the signal indicative of the rate of change of the disturbance variable based on an aggressiveness of tuning determined based on the magnitude of the difference between the signal indicative of the setpoint and the signal indicative of the measured temperature of the output steam.

4. The method of claim 3, wherein adjusting the signal indicative of the rate of change of the disturbance variable based on the aggressiveness of the tuning determined based on the magnitude of the difference between the signal indicative of the setpoint and the signal indicative of the measured temperature of the output steam comprises increasing a magnitude of an adjustment to the signal indicative of the rate of change of the disturbance variable as the magnitude of the difference between the signal indicative of the setpoint and the signal indicative of the measured temperature of the output steam increases.

5. The method of claim 4, wherein adjusting the signal indicative of the rate of change of the disturbance variable based on the aggressiveness of tuning based on the magnitude of the difference between the signal indicative of the setpoint and the signal indicative of the measured temperature of the output steam further comprises decreasing the magnitude of the adjustment to the signal indicative of the rate of change of the disturbance variable as the magnitude of the difference between the signal indicative of the setpoint and the signal indicative of the measured temperature of the output steam decreases.

6. The method of claim 1, further comprising:

providing the signal indicative of the rate of change of the disturbance variable to a first input of the dynamic matrix controller, and providing the signal corresponding to the error to a second input of the dynamic matrix controller; and wherein adjusting the signal indicative of the rate of change of the disturbance variable is performed by the dynamic matrix controller based on the signals received at the first input and at the second input.

7. The method of claim 1, further comprising providing a signal indicative of a magnitude of the error to an input of a function block, modifying the signal indicative of the magnitude of the error using a function included in the function block, and generating an output of the function block based on the modified signal indicative of the magnitude of the error; and wherein adjusting the signal indicative of the rate of change of the disturbance variable based on the signal corresponding to the error comprises adjusting the signal indicative of the rate of change of the disturbance variable based on the output of the function block.

8. The method of claim 7, further comprising:

providing the signal indicative of the rate of change of the disturbance variable to a first input of the dynamic matrix controller, providing a signal indicative of the output of the function block to a second input of the dynamic matrix controller; and wherein adjusting the signal indicative of the rate of change of the disturbance variable based on the output of the function block comprises adjusting, by the dynamic matrix controller, the signal indicative of the rate of change of the disturbance variable based on the signals received at the first input and at the second input of the dynamic matrix controller.

9. The method of claim 1, wherein:

controlling, based on the control signal, the manipulated variable of the control loop of the steam generating boiler system to thereby control the temperature of the output steam comprises providing the control signal to a field device of the control loop of the steam generating boiler system; and the field device corresponds to one of a plurality of sections of the steam generating boiler system, the plurality of sections including a furnace, a superheater section and a reheater section.

10. The method of claim 1, wherein adjusting the signal indicative of the rate of change of the disturbance variable of the portion of the steam generating boiler system includes adjusting respective values of respective signals indicative of respective rates of change of at least one of: a furnace burner tilt position; a steam flow; an amount of soot blowing; a damper position; a power setting; a fuel to air mixture ratio of a furnace of the steam generating boiler system; a firing rate of the furnace; a spray flow; a water wall steam temperature; a load signal corresponding to one of a target load or an actual load of the turbine; a flow temperature; a fuel to feed water ratio; the temperature of the output steam; a quantity of fuel; a type of fuel, another manipulated variable of the portion of the steam generating boiler system, or a control variable of the portion of the steam generating boiler system.

* * * * *